US005745092A

United States Patent [19]

Ito

[11] Patent Number: 5,745,092

[45] Date of Patent: Apr. 28, 1998

[54] LIQUID-CRYSTAL DISPLAY SYSTEM AND POWER SUPPLY METHOD THAT SUPPLY DIFFERENT LOGIC SOURCE VOLTAGES TO SIGNAL AND SCAN DRIVERS

[75] Inventor: Satoru Ito, Suwa, Japan

[73] Assignee: Seiko Epson Corporation, Tokyo, Japan

[21] Appl. No.: 735,947

[22] Filed: Oct. 23, 1996

Related U.S. Application Data

[63] Continuation of Ser. No. 360,058, Dec. 20, 1994, abandoned.

[30] Foreign Application Priority Data

Dec. 22, 1993 [JP] Japan ..... 5-325170

[51] Int. Cl.[6] ..... G09G 3/36

[52] U.S. Cl. ..... 345/95; 345/211

[58] Field of Search ..... 345/92, 87, 88, 345/94, 95, 97, 99, 100, 211, 212; 359/54, 56, 59; 348/790, 791, 792; H04N 3/14

[56] References Cited

U.S. PATENT DOCUMENTS

| | | | |
|---|---|---|---|
| 4,523,232 | 6/1985 | Kameda et al. | 348/790 |
| 4,556,880 | 12/1985 | Hamada | 345/87 |
| 4,769,639 | 9/1988 | Kawamura et al. | 345/88 |
| 5,066,945 | 11/1991 | Kanno et al. | 345/94 |
| 5,323,171 | 6/1994 | Yokouchi et al. | 345/94 |

FOREIGN PATENT DOCUMENTS

| | | |
|---|---|---|
| WO 93/18501 | 4/1993 | Japan . |
| 05249926 | 9/1993 | Japan . |
| 6-130910 | 5/1994 | Japan . |

*Primary Examiner*—Chanh Nguyen

*Attorney, Agent, or Firm*—Oliff & Berridge, PLC

[57] ABSTRACT

An object is to provide a power supply technique which is optimum when the source voltage range of a signal driver is different from that of a scan driver. A power supply unit supplies a source voltage group of V11, VC1 and V12 of the same polarity having a narrower source voltage range to the signal driver and another source voltage group of V10, VC2 and V15 of the same polarity having a wider source voltage range to the scan driver. The center voltages VC1 and VC2 within these source voltage ranges are equal to each other. The power supply unit has a means for adjusting the source voltages. A control signal and other signals from a control unit are transformed in level by a potential transforming unit. When it is desired to accomplish the display-off function, the outputs of the signal and scan drivers are set to be equal to VC level. Thus, the adjustment of liquid-crystal driving voltages can be accomplished by a simplified adjustment device while maintaining the accurate ratio of voltage division.

22 Claims, 19 Drawing Sheets

LIQUID-CRYSTAL PANEL
4
SIGNAL DRIVER
2
10
SCAN DRIVER
3
11
CONTROL (SYSTEM SIDE)
1
POWER SUPPLY
5
58
6
12
V11
VC1 (=VC)
V12
VD1
VS1
V10
VC2(=VC)
V15
tY
DYnm
DOFF
FR
VD
GND
LP
tX
DXm
ST
VLCD

N-TYPE OPERATIONAL AMPLIFIER

P-TYPE OPERATIONAL AMPLIFIER

FIG. 10A

SCAN DRIVER

| FR | DYn1 | DYn2 | DOFF | OUTPUT 35 |
|---|---|---|---|---|
| L | L | L | H | VC |
| L | H | L | H | V10 |
| L | L | H | H | V15 |
| L | H | H | H | VC |
| H | L | L | H | VC |
| H | H | L | H | V15 |
| H | L | H | H | V10 |
| H | H | H | H | VC |
| * | * | * | L | VC |

FIG. 10B

SIGNAL DRIVER

| FR | DX1 | DX2 | DOFF | OUTPUT 57 |
|---|---|---|---|---|
| L | L | L | H | V11 |
| L | H | L | H | VC |
| L | L | H | H | V12 |
| L | H | H | H | VC |
| H | L | L | H | V12 |
| H | H | L | H | VC |
| H | L | H | H | V11 |
| H | H | H | H | VC |
| * | * | * | L | VC |

LIQUID-CRYSTAL DISPLAY SYSTEM AND POWER SUPPLY METHOD THAT SUPPLY DIFFERENT LOGIC SOURCE VOLTAGES TO SIGNAL AND SCAN DRIVERS

This is a Continuation application Ser. No. 08/360,058 filed Dec. 20, 1994, now abandoned.

BACKGROUND OF THE INVENTION

1. Field of the Invention

The present invention relates to a power supply technique in a liquid-crystal display system comprising a signal driver (signal electrode drive circuit) and a scan driver (scan electrode drive circuit).

2. Description of the Related Art

One of the conventional liquid-crystal drive techniques is to drive a liquid-crystal through an amplitude selective addressing scheme (a voltage averaging process). Such a liquid-crystal drive technique sequentially selects scan electrodes one at a time and applies a scan voltage to the selected scan electrode. Depending on whether each of pixels on the selected scan electrode is ON or OFF, a signal voltage is applied to the corresponding signal electrode to drive the liquid-crystal.

FIG. 19 shows the relationship between source voltages in the amplitude selective addressing scheme. Symbols V0, V1, V2, V3, V4 and V5 denote a group of source voltages used in the amplitude selective addressing scheme for driving the liquid-crystal. The source voltages V0, V2, V3 and V5 are supplied to a signal driver while the source voltages V0, V1, V4 and V5 are supplied to a scan driver. The relationship between these source voltages is $V0 \geqq V1 \geqq V2 \geqq V3 \geqq V4 \geqq V5$. Ground potential GND is common to the signal driver, the scan driver and a control unit for controlling these drivers. VD designates a logic source voltage ranging between 3 volts and 5 volts. This logic source voltage VD is also common to the signal driver, scan driver and control unit. Thus, a control signal from the control unit can be provided directly to the signal and scan drivers. It is assumed in FIG. 19 that the ground potential GND is equal to the minimum driving potential V5 while VDDH is equal to the maximum driving potential V0. As will be apparent from FIG. 19, the range of source voltage A1 to which the group of source voltages V0, V2, V3 and V5 applied to the signal drive belongs is equal to the range of source voltage A2 to which the group of source voltages V0, V1, V4 and V5 applied to the scan driver belongs.

In the conventional liquid-crystal display systems using the amplitude selective addressing scheme, it is known to use a display-off or LCD-OFF function. Such a function is to force a voltage to be applied to a liquid-crystal element into zero. This can prevent any voltage from being applied to the liquid-crystal for a given time period through which the output voltage of the driver becomes unstable after the power is ON. Further, the voltage to be applied to the liquid-crystal element can be made zero to deenergize the display and to save the power while the power to the liquid-crystal display system is ON. In the prior art, the display-off function is accomplished by outputting the common potential V5 (=GND) simultaneously from both the signal and scan drivers to make the voltage to be applied to the liquid-crystal element zero.

Recently, there has been proposed a multiple lines selective drive technique for selecting and driving a plurality of lines simultaneously. Such a multiple lines selective drive technique is described by the present applicant in Japanese Patent Application Nos. Hei 5-515531 and Hei 5-152533. This multiple lines selective drive technique can provide a liquid-crystal display system which shows more rapid response than the prior art with high contrast and less flicking. In addition to provision of the same ON/OFF ratio as in the prior art (amplitude selective addressing scheme), the driving voltage for the signal driver can be reduced. Consequently, low voltage LSI process can be used to increase the integrity in the signal drivers and to reduce the area of the chips. This also leads to improvement of the performance in the signal drivers and to reduction of the manufacturing cost.

However, the multiple lines selective drive technique requires a driving voltage for the scan driver which is in the same level as in the earlier techniques. Further, the signal driver requires a driving voltage different from that of the scan driver. Therefore, the range of source voltage for the signal driver must be different from that of the scan driver. This raises a problem in that the conventional power supply techniques cannot be applied directly to the multiple lines selective driver technique.

Semiconductor devices constituting liquid-crystal elements, drivers and others for a liquid crystal panel has a problem in that there is a fluctuation in their characteristics due to fluctuation in the manufacturing process and so on. Thus, the prior art requires an adjustment which optimizes driving voltages to be applied to signal and scan electrodes after the liquid-crystal display system has been assembled in the factory. With a liquid-crystal display system capable of adjusting the contrast in the liquid-crystal display, such an adjustment is accomplished by regulating driving voltages to be applied to the signal and scan electrodes. Thus, the prior art requires the adjustment of driving voltage to perform the optimization of driving voltage or adjustment of contrast. However, the multiple lines selective drive technique requires different ranges of source voltage for the signal and scan drivers. This means that the drive voltage adjusting techniques used in the conventional liquid-crystal display systems through the amplitude selective addressing scheme cannot be applied directly to the multiple lines selective drive technique.

In the conventional liquid-crystal drivers using the amplitude selective addressing scheme, the display-off function is accomplished by setting the outputs of the signal and scan drivers at a level equal to the source voltage V5 (=GND) on the low-potential (or high-potential) side. If the ranges of source voltage for the signal and scan drivers are different from each other, however, the source voltages on the low-potential side is not equal. Thus, the voltage to be applied to the liquid-crystal is not "0", and the display-off function cannot be accomplished.

SUMMARY OF THE INVENTION

It is therefore an object of the present invention to provide a power supply technique which is optimum for use when the ranges of source voltage for the scan and signal drivers are different from each other.

Another object of the present invention is to provide a power supply technique which can adjust a drive voltage to be applied to a source voltage element even if the ranges of source voltage for the scan and signal drivers are different from each other.

Still another object of the present invention is to accomplish the display-off function in a liquid-crystal display system in which the ranges of source voltage for the scan and signal drivers are different from each other.

To this end, the present invention provides a liquid-crystal display system comprising a signal driver for applying driving voltages to a plurality of signal electrodes which are disposed crossing over a plurality of scan electrodes in a matrix panel including a plurality of pixels arranged in a matrix, a scan driver for applying driving voltages to the scan electrodes and power supply means for supplying source voltages to said signal and scan drivers, said power supply means comprising means for supplying a first group of source voltages having a first range of source voltage and the same polarity to one of said signal and scan drivers, means for supplying a second group of source voltages having a second range of source voltage wider than the first range of source voltage and the same polarity to the other of said signal and scan drivers, and means for setting a first center voltage in the first range of source voltage and a second center voltage in the second range of source voltage to a same level.

According to the present invention, the first source voltage group of the same polarity within the first narrower range of source voltage are provided to one of the signal and scan drivers while the second source voltage group of the same polarity within the second wider range of source voltage is applied to the other of the signal and scan drivers. The source voltages are then provided such that the center voltages within their ranges of source voltages are setting to the same level. Since the source voltage group applied to one of the drivers has the same polarity, these source voltages can be adjusted by any simple adjustment means. This leads to reduction of the necessary parts and to improvement of the reliability. When the voltages are adjusted, the ratio of voltage division can accurately be maintained independently of whether the source voltages are on the side of positive or negative polarity relative to the center voltage. Thus, the present invention provides a power supply technique which is optimum for use as in the multiple lines selective drive process.

According to the present invention, the power supply means is also characterized in that it comprises means for generating said first and second source voltage groups by dividing a voltage between a fixed potential and a reference potential for generating a liquid-crystal driving voltage to generate divided voltages at divided terminals, and means responsive to the divided voltage generated at one of said divided terminals for generating said first and second center voltages, thereby setting the first and second center voltages to the same level.

According to the present invention, the first and second source voltage groups may be generated by the use of any simple voltage dividing means using resistors, transistors and others. In addition, the first and second center voltages can be setting to the same level by simply generating the first and second center voltages base on the divided voltage generated at one of the divided terminals.

The present invention further comprises means for adjusting the reference potential for generating the liquid-crystal driving voltage to regulate the divided voltages and to adjust the voltages in the first and second source voltage groups.

According to the present invention, thus, the source voltages in the first and second groups can be regulated while maintaining the accurate ratio of voltage division through the simple technique for adjusting the reference potential for generating the liquid-crystal driving voltage. After the liquid-crystal display system has been assembled in the factory or the like, therefore, the driving voltage for liquid-crystal elements can be optimized while the contrast in the liquid-crystal display can be regulated. Such adjusting means may be in the form of a voltage adjusting unit formed by a variable resistor or operational amplifier.

The present invention is also characterized by that said power supply means comprises means for supplying a voltage within said first source voltage range as a logic source voltage for one of said drivers to which said first source voltage group is supplied.

According to the present invention, the logic source voltage in one of the drivers to which the first source voltage group within the narrower range of source voltage are applied is set in the first source voltage range. Thus, the one driver does not require increase of the operational source voltage range to actuate the logic circuit included in the one driver. This means that the operational source voltage range for the one driver can be reduced. Thus, the one driver can be produced through a low voltage LSI process to reduce the chip area as well as the manufacturing cost.

The present invention is further characterized by that the fixed potential source on the low- or high-potential side of the one driver to which the first group of source voltages are supplied is separated from the fixed potential source on the low- or high-potential side of the other driver to which the second source voltage group is supplied.

According to the present invention, the fixed potential sources in the one and other drivers are separated from each other. It is thus not required to increase the operational source voltage range in the one driver according to the operational source voltage range in the other driver. Therefore, the operational source voltage range can be reduced. Thus, the one driver can be produced through a low voltage LSI process to reduce the chip area as well as the manufacturing cost.

The present invention is further characterized by that it comprises means for outputting at least a control signal to the signal and scan drivers and potential transforming means for transforming the potential level of said control signal to the one driver to which the first group of source voltages are supplied into a level within the first range of source voltage.

According to the present invention, the control signal and other signals are inputted into the one driver after its potential level has changed. Therefore, the control signal and other signals can properly be transmitted to the one driver which is operable within the narrower range of source voltage.

The present invention is further characterized by that the potential transforming means includes a capacitive coupling capacitor for cutting out DC components.

According to the present invention, the capacitive coupling capacitor can take out only an amount of voltage change in the control signal to facilitate the conversion of potential level.

The present invention is further characterized by means for setting the driving voltages from the signal and scan drivers to the same level as the first and second center voltages when a given external signal is inputted into the liquid-crystal display system.

According to the present invention, the output voltages of the signal and scan drivers are equal to each other or become the same center voltage when an external signal such as a display-off signal is inputted. Thus, the voltage to be applied to the liquid-crystal element can be made "0". For example, this may realize a display-off function in the liquid-crystal display. This also eliminates any need of generating a new voltage for this function.

BRIEF DESCRIPTION OF THE DRAWINGS

FIGS. 10A and 10B are tables illustrating the relationship between the control and data signals and the outputs in the scan driver and the relationship between the control and data signals and the outputs in the signal driver, respectively.

DETAILED DESCRIPTION OF THE PREFERRED EMBODIMENTS

The present invention will now be described by way of example with reference to the drawings.

(First Embodiment)

1. The Whole Arrangement

Figure 1:
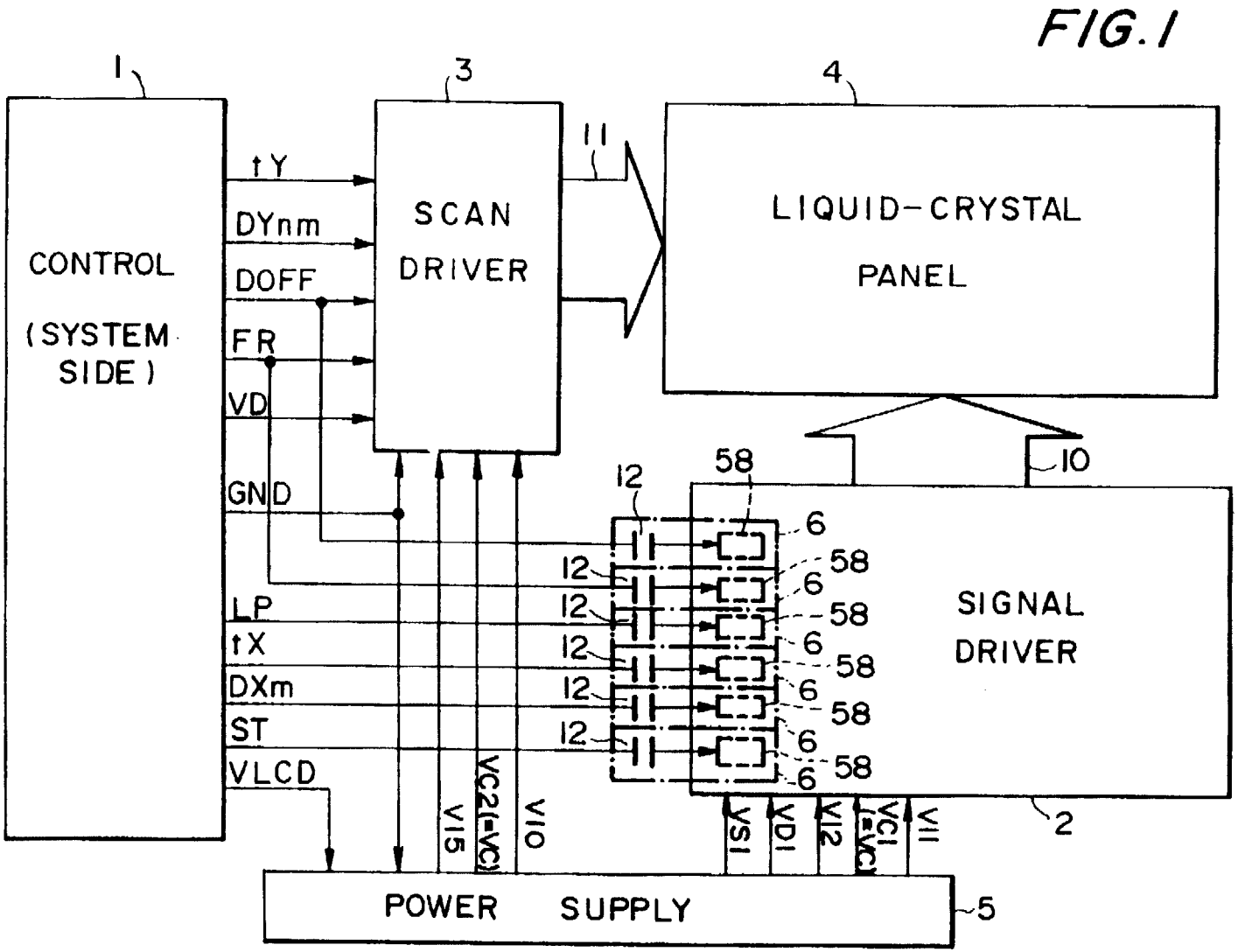
FIG. 1 is a block diagram showing the entire layout of a liquid-crystal display system of the first embodiment constructed in accordance with the present invention.

FIG. 1 is a block diagram of the entire layout of a liquid-crystal display system for the first embodiment of the present invention. The liquid-crystal display system of the first embodiment comprises a control unit 1, a signal driver 2, a scan driver 3, a liquid-crystal panel 4, a power supply unit 5 and a plurality of potential transforming units 6. The control unit 1 is adapted to output control signals and signal data toward the signal driver 2, and control signals and scan data toward the scan driver 3. The signal driver 2 is responsive to the control signal and signal data from the control unit 1 for outputting a driving voltage 10 toward signal electrodes in the liquid-crystal panel 4. The scan driver 3 is responsive to the control signal and scan data from the control unit 1 for outputting a driving voltage 11 toward scan electrodes in the liquid-crystal panel 4. The liquid-crystal panel 4 comprises a plurality of signal electrodes, a plurality of scan electrodes crossing with the signal electrodes and a plurality of liquid-crystal elements arranged at crossing points between the signal and scan electrodes, the liquid-crystal elements being driven by the drive signals from the signal and scan drivers 2, 3. The power supply unit 5 generates a source voltage group to be supplied to the signal and scan drivers 2, 3 based on a reference voltage VLCD which is supplied from the control unit 1 and becomes a reference for a liquid crystal driving voltage. The potential transforming unit 6 comprises a capacitive coupling capacitor (condenser) 12 and a DC level transmitting unit 58 and is adapted to change the potential levels of the control signal, signal data and scan data from the control unit 1.

The control unit 1 further outputs various other signals, DOFF signal used to perform the display-off function for the liquid-crystal panel, FR signal used to perform AC liquid-crystal drive, LP signal being latch pulse, tX signal being data transfer clock, DXm signal being 2-bit data signal and ST signal being sampling start signal to the signal driver 2. In this embodiment, ground potential GND and logic source voltage VD will not be supplied from the control unit 1 to the signal driver 2. In other words, the power source for the reference potential (GND in the control unit 1 and VS1 in the signal driver 2) on the low-potential side and logic source voltage (VD in the control unit 1 and VD1 in the signal driver 2) is not common to the control unit 1 and the signal driver 2.

From the control unit 1, the scan driver 3 receives DOFF signal, FR signal, tY signal being data transfer clock and DYnm signal being scan data of 2 bits×2 lines. In this embodiment, the control unit 1 also gives ground potential GND and logic source voltage VD to the scan driver 3. In other words, the power source for the reference potential GND on the low-potential side and logic source voltage VD is common to the control unit 1 and the scan driver 3.

The power supply unit 5 receives VLCD which is a reference used to generate liquid-crystal driving voltages. The power supply unit 5 supplies a group of source voltages V11, VC1 (=VC), V12, VD1 and VS1 to the signal driver 2 and another group of source voltages V10, VC2 (=VC) and V15 to the scan driver 3.

2. Power Supply Unit

Figure 2:
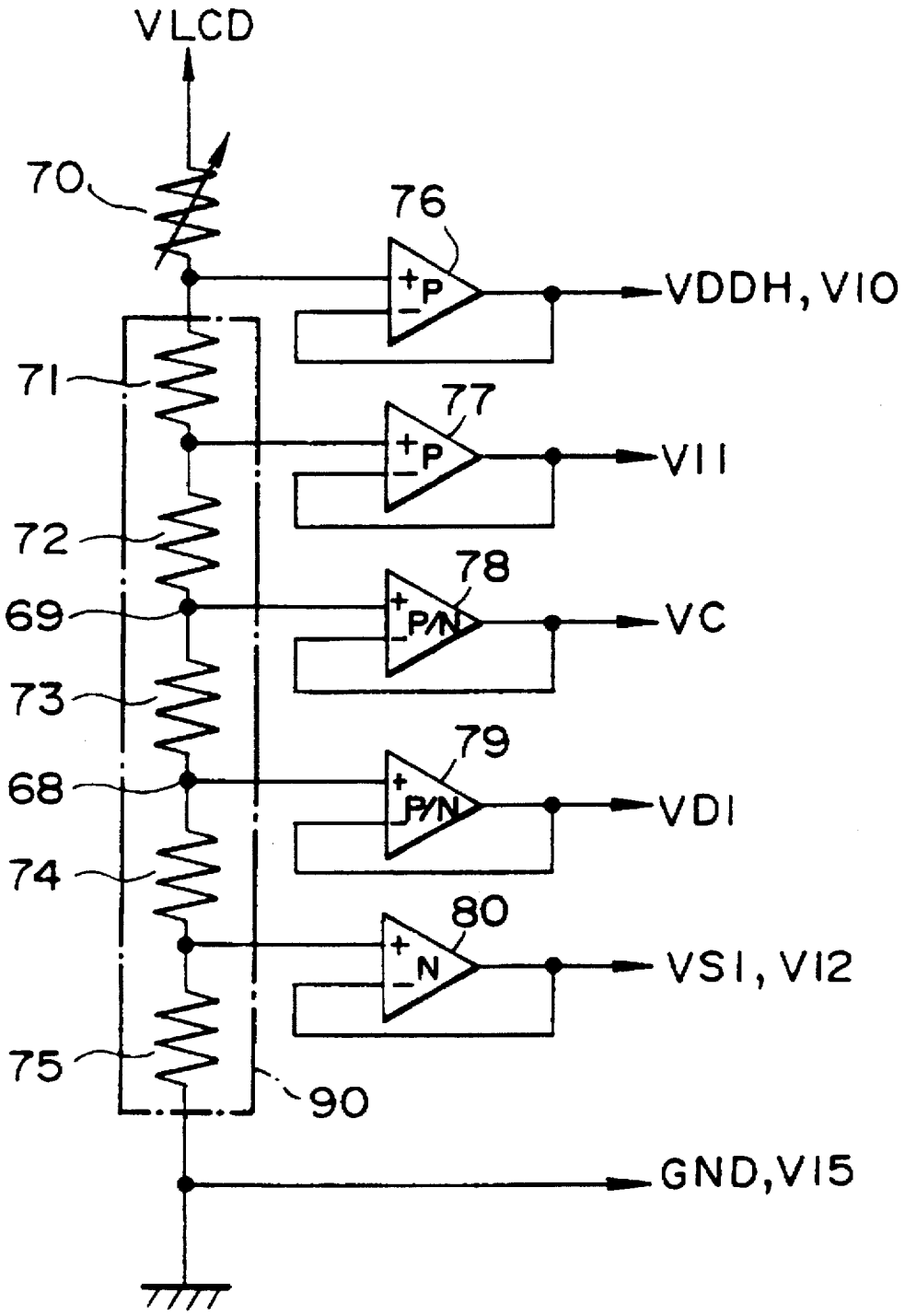
FIG. 2 is a circuit diagram showing an arrangement of a power supply unit.
Figure 3:
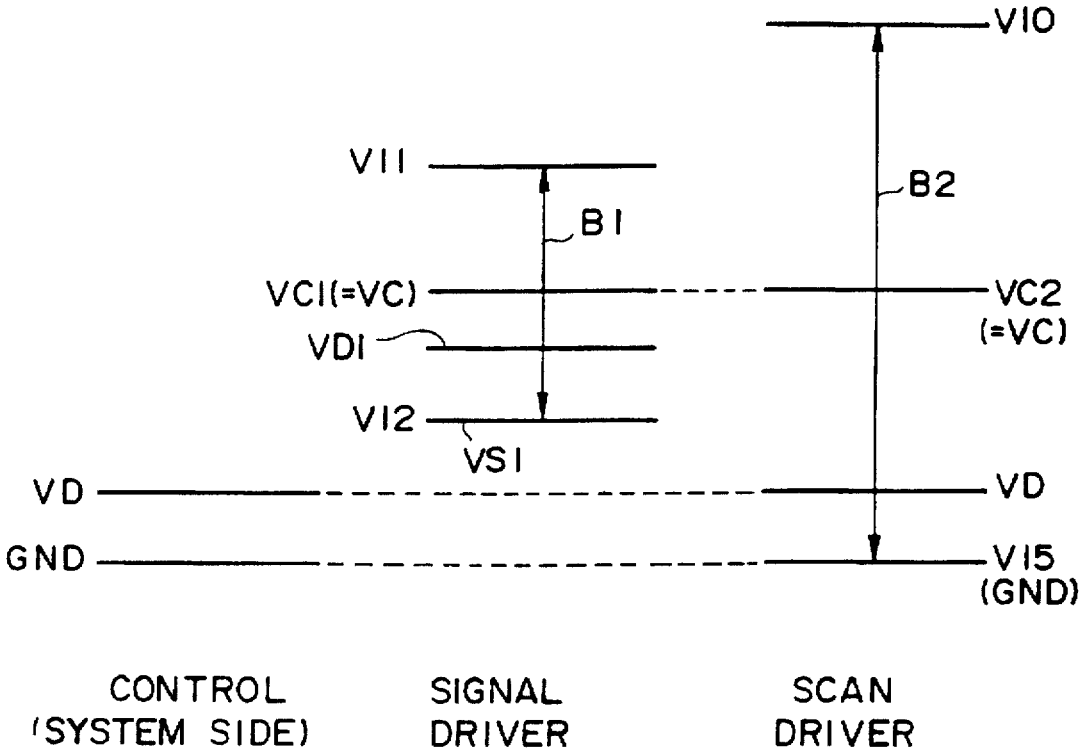
FIG. 3 is a diagram showing the relationship between source voltage groups which are used in the first embodiment.
Figure 4B:
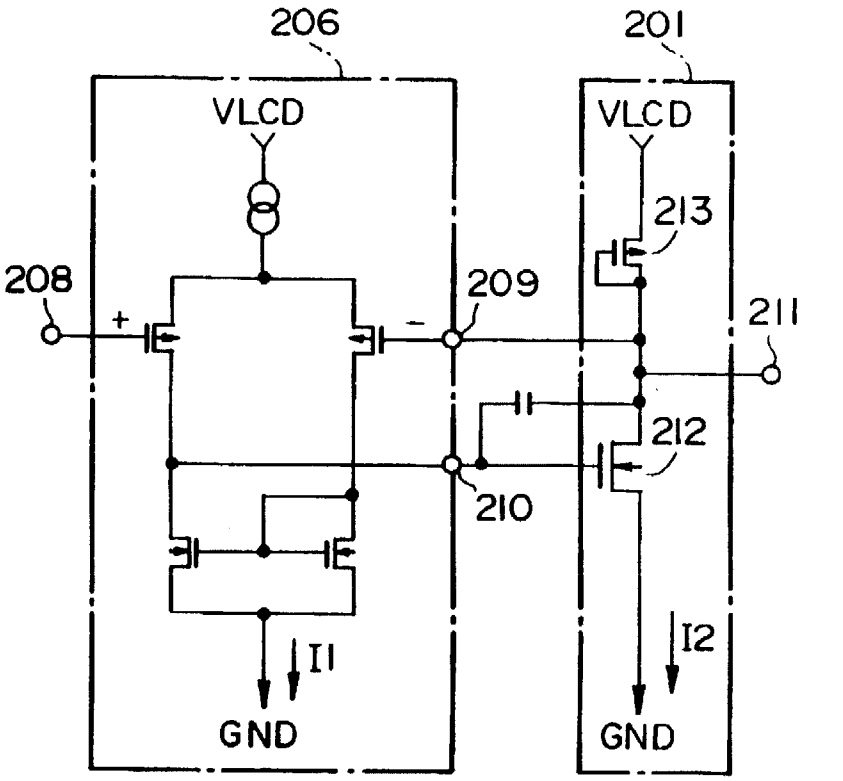
FIGS. 4A and 4B are circuit diagrams showing examples of P-type and N-type operational amplifiers, respectively.
Figure 4A:
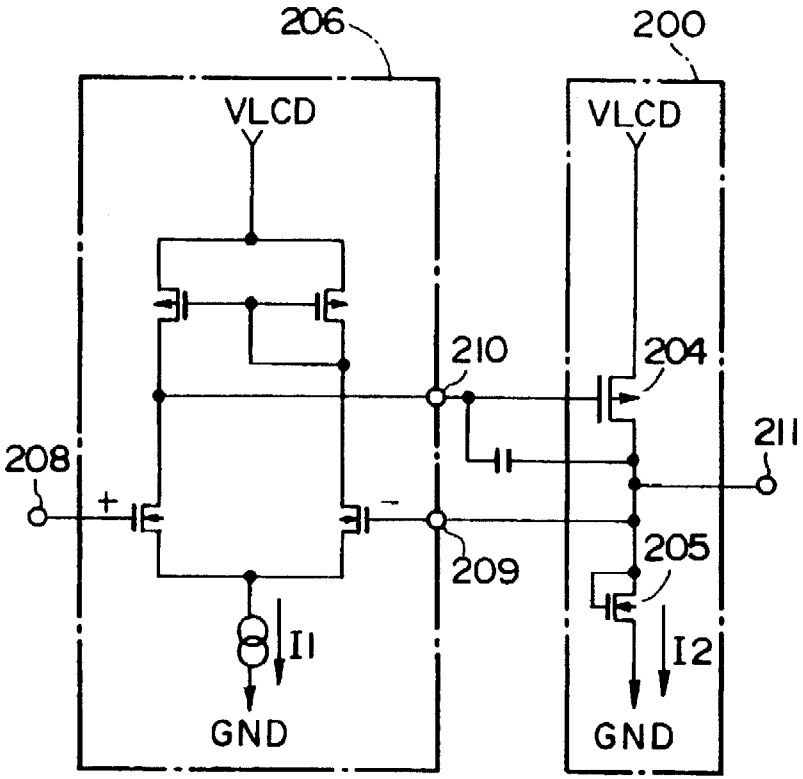

FIG. 2 shows an example of the power supply unit 5. FIG. 3 shows the relationship between the groups of source voltages V11, VC, V12, VD1, VS1, V10, VC and V15 from the power supply unit 5 and the group of source voltages VD and GND from the control unit 1. The power supply unit 5 comprises a variable resistor 70 for adjusting the source voltages, a voltage dividing unit 90 including a plurality of resistors 71, 72, 73, 74 and 75 connected in series to one another which are used to generate a plurality of voltages required by the multiple lines selective drive technique, and a plurality of operational amplifiers 76, 77, 78, 79 and 80 connected in the voltage follower manner and adapted to subject the voltages generated at the divided terminals of the voltage dividing unit 90 to impedance conversion. V10 (=VDDH) and V11 are coupled with the P-type operational amplifiers 76 and 77; VC and VD1 being coupled with the P-N switch type operational amplifiers 78 and 79 and V12 (=VS1) being coupled with the N-type operational amplifier 80. In the P-type operational amplifiers 76 and 77, an output 210 of a differential unit 206 is inputted into a P-type drive transistor 204 in a drive unit 200 as shown in FIG. 4A. On the other hand, in the N-type operational amplifier 80, output 210 of the differential unit 206 is inputted into an N-type drive transistor 212 in a drive unit 201 as shown in FIG. 4B. A source voltage which has its charge of negative polarity to be moved from a liquid-crystal element to an operational amplifier within one frame (or in which the negative load is dominant) is subjected to impedance conversion by the P-type operational amplifier. A source voltage which has its charge of positive polarity to be moved from a liquid-crystal element to an operational amplifier within one frame (or in which the positive load is dominant) is subjected to impedance conversion by the N-type operational amplifier. A source voltage in which the positive or negative loads is dominant is subjected to impedance conversion by the P-N switch type operational amplifier. When the operational amplifiers performing such an impedance conversion are switched from one to another for various source voltage, the power consumption in the operational amplifiers can be reduced without reduction of the liquid-crystal display quality.

It is to be noted herein that semiconductor devices constituting liquid-crystal elements, signal driver or the like have a fluctuation in characteristic due to fluctuation in the manufacturing process and others. This requires an adjustment which optimizes the driving voltages to the liquid-crystal elements after the liquid-crystal display system has been assembled in the factory or the like. The drive voltages must also be adjusted to accomplish a contrast adjustment for the liquid-crystal display. In this embodiment, thus, the resistance value of the variable resistor 70 is regulated to adjust the source voltages V10, V11 and so on. As a result, the driving voltages to the liquid-crystal elements can be adjusted. Such an adjustment technique can regulate the driving voltages while accurately maintaining the ratio of voltage division in the voltage dividing unit 90.

Figure 5:
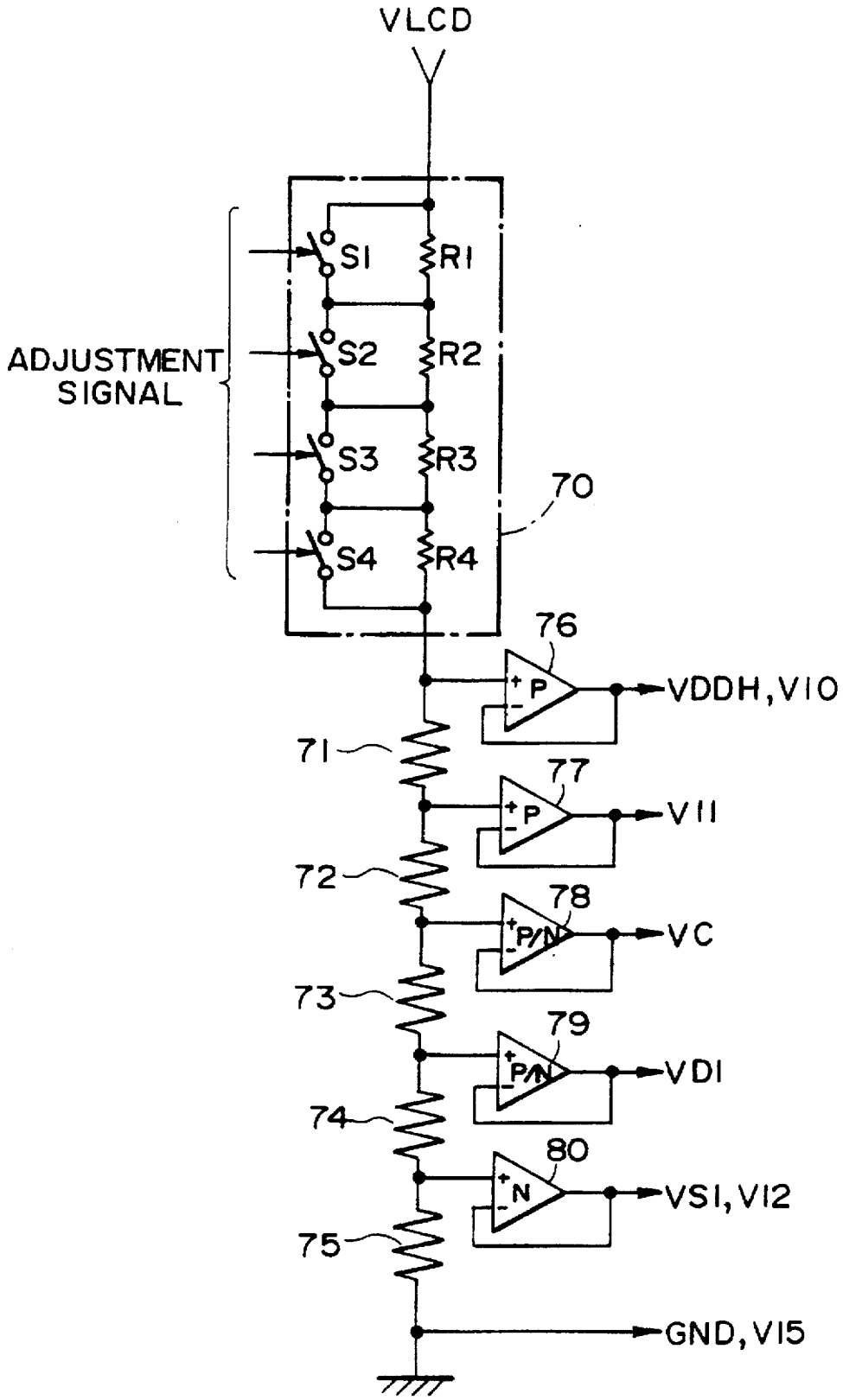
FIG. 5 is a circuit diagram showing another power supply unit.
Figure 6:
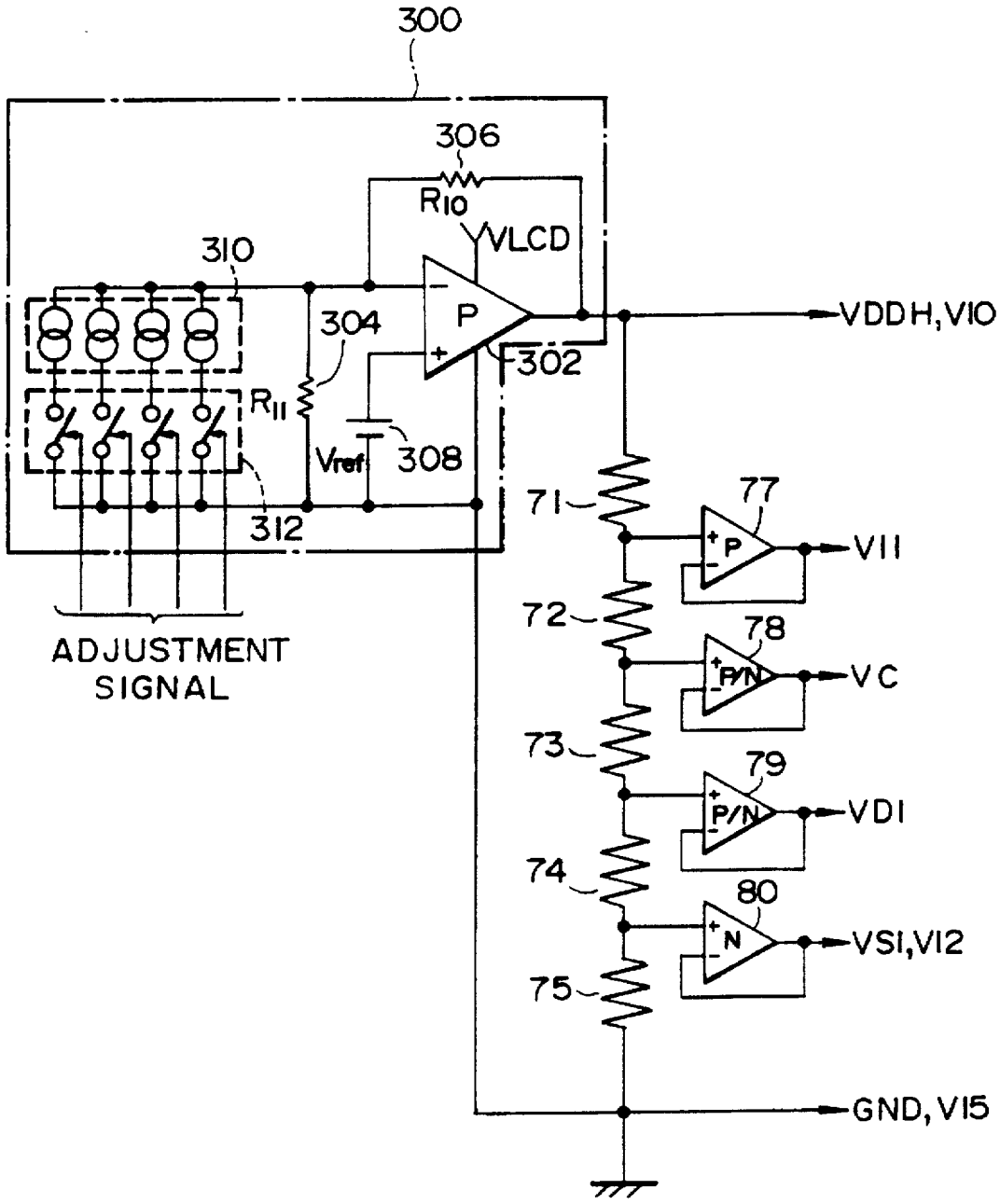
FIG. 6 is a circuit diagram showing still another power supply unit.

Further, the variable resistor 70 may be formed by connecting resistors R1–R4 and switches S1–S4, as shown in FIG. 5. If adjustment signals are controlled to actuate the switches S1–S4 through any external CPU or the like, thus, the resistance value of the variable resistor 70 may be adjusted to enable the contrast adjustment for liquid-crystal display. If the liquid-crystal display system includes a voltage regulating unit 300 as shown in FIG. 6 for regulating VDDH voltage being a reference voltage used to generate the liquid-crystal driving voltages, the source voltage may be regulated similarly. The voltage regulating unit 300 may comprise an operational amplifier 302, resistors 304 and 306, a source of reference voltage 308, a source of constant current 310 and a switch unit 312. In such an arrangement, a center value for voltage regulation can be determined by resistances R10 and R11 and reference voltage Vref, and a constant current can be provided to the resistor 306 through the switch unit 312 and constant current source 310. Thus, the voltages can be regulated about the center value.

Each of the resistors 71–75 may be replaced by a transistor in which the drain region is connected to the gate electrode.

The potential relationship between the source voltages will be described with reference to FIG. 3. Since this embodiment takes the multiple lines selective drive technique, a range of source voltage B1 required by the signal driver can be reduced. As shown in FIG. 3, thus, such a range of source voltage B1 for the signal driver is narrower than a range of source voltage B2 for the scan driver. This embodiment is further adapted to supply the electric power such that the center voltage, VC1=(V11+V12)/2, in the voltage range B1 will be equal to the center voltage, VC2=(V10+V15)/2, in the voltage range B2. As shown in FIG. 2, this can be accomplished by generating a center voltage VC=VC1=VC2 based on a divided voltage which is generated at a divided terminal 69. In this embodiment, furthermore, the power source for the logic source voltage VD and the fixed potential GND on the low-potential side are common to the control unit 1 and the scan driver 3. On the other hand, the power source for the logic source voltage and fixed potential on the low-potential side is not common to the control unit 1 and the signal driver 2. The signal driver 2 has the logic source voltage VD1 and the fixed potential VS1 (=V12) on the low-potential side. More particularly, this embodiment sets the logic source voltage VD1 of the signal driver at a level within the source voltage range B1 separately from VD. This may be accomplished by generating VD1 based on a divided voltage which is generated at a divided terminal 68 in the voltage dividing unit 90 of FIG. 2.

Figure 7:
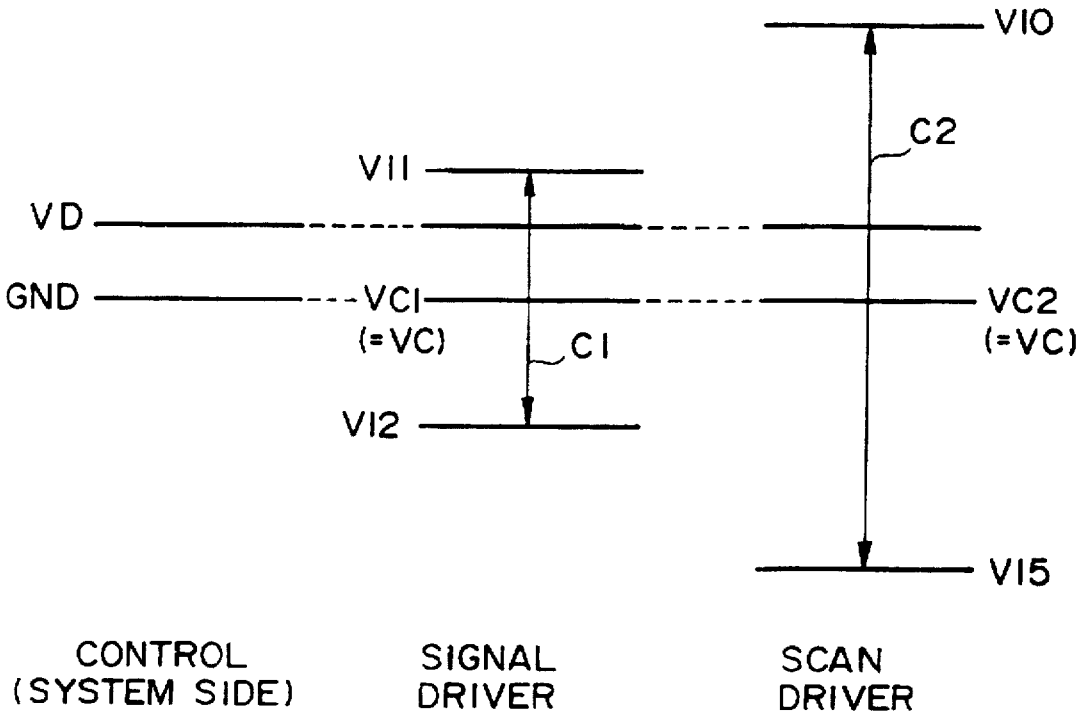
FIG. 7 is a diagram showing the relationship between source voltage groups when their center voltages are GND.

The power source of this embodiment is such constructed as shown in FIG. 3 for the following reason. Provision of the center voltage VC1=VC2 symmetrizes the characteristics of a PMOS transistor for outputting V11 with those of an NMOS transistor for outputting V12 to simplify the design. Moreover, the provision of the center voltage substantially symmetrize the rising edge waveform of the driver output with the falling edge waveform of the same to reduce DC components which may be harmful for liquid-crystal drive. When VC1=VC2, the source voltages may be placed in such a relationship as shown in FIG. 7. In such a case, the relationship becomes VC1=VC2=GND and the polarity of V11 is different from the polarity of V12 and the polarity of V10 is different from the polarity of V15. If the power source is of such a construction as shown in FIG. 7, a simple power supply unit as shown in FIG. 2 (or FIGS. 5 and 6) cannot be taken to generate the source voltage group. Although the power source of FIG. 3 can regulate the source voltages through a simple technique of regulating the resistance value of the variable resistor 70 while maintaining the ratio of voltage division accurate, the power source of FIG. 7 cannot regulate the source voltages through such a simple technique. This is because all the source voltage group supplied to the signal and scan drivers 2, 3 in FIG. 3 are of the same polarity. In other words, when all the source voltage group are of the same polarity, the source voltage group V10, V11 and others can be obtained simply by dividing the reference potential VLCD on the high-potential side and fixed potential GND on the low-potential side, as shown in FIG. 2. The potential levels of V10, V11 and others can be regulated simply by regulating the variable resistor 70 while maintaining the ratio of voltage division accurate. On the contrary, since the source voltages of positive and negative polarities must be generated separately in FIG. 7, there are required separate reference potentials corresponding to VLCD in FIG. 2 and having positive and negative polarities, respectively. The voltage adjustment must also be carried separately by a variable resistor for positive polarity and another variable resistor for negative polarity. However, variable resistor and other resistors for voltage division may have a fluctuation in characteristics due to fluctuation in the manufacturing process or the like. Such a fluctuation may not maintain the ratios of voltage division in the positive and negative polarity sides at the same value. This means that the quality of liquid-crystal display may be degraded. According to this embodiment, however, such a situation will not be raised since all the source voltage group are of the same polarity.

Figure 15:
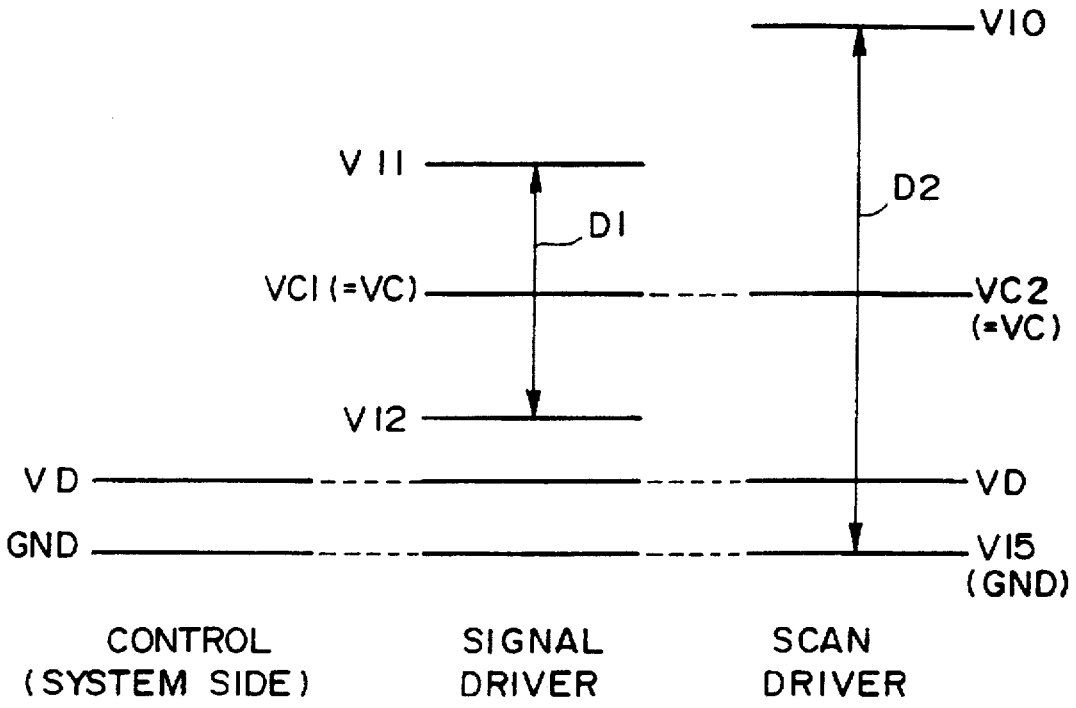
FIG. 15 is a diagram illustrating the relationship between source voltage groups in the second embodiment.

The fact why the logic source voltage VD1 and fixed potential VS1 on the low-potential side of the signal driver does not have a common power source with VD and GND in this embodiment is as follows. If it is assumed that the logic source voltage of the signal driver is VD and the fixed potential on the low-potential side is GND, the source voltage range of the signal driver will be increased larger than that of FIG. 3, as shown in FIG. 15. This means that the signal driver must be produced through a high voltage LSI process that leads to the increased chip area and higher manufacturing cost. In this embodiment, such a problem can be avoided by setting VD1 within the source voltage range B1 to separate the fixed potential VS1 on the low-potential side and GND.

Figure 8A:
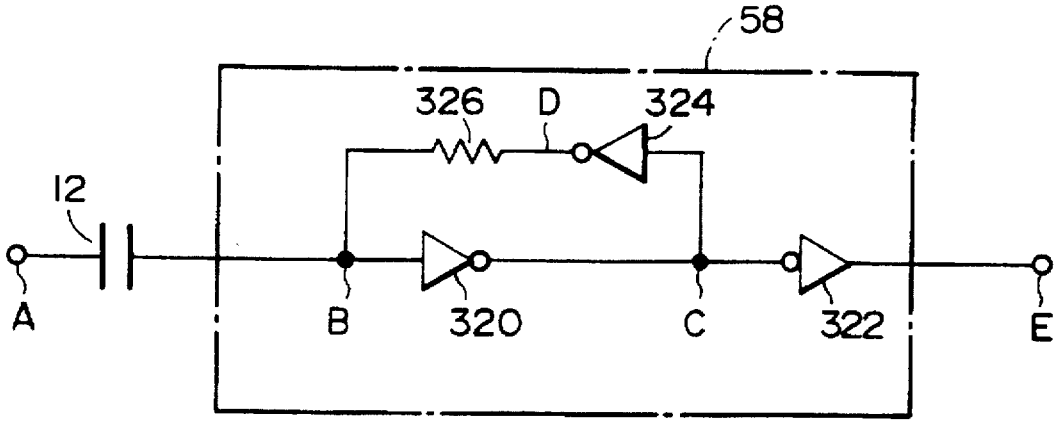
FIG. 8A is a circuit diagram showing an example of a potential transforming unit and FIG. 8B is a diagram showing a voltage waveform illustrating its operation.
Figure 8B:
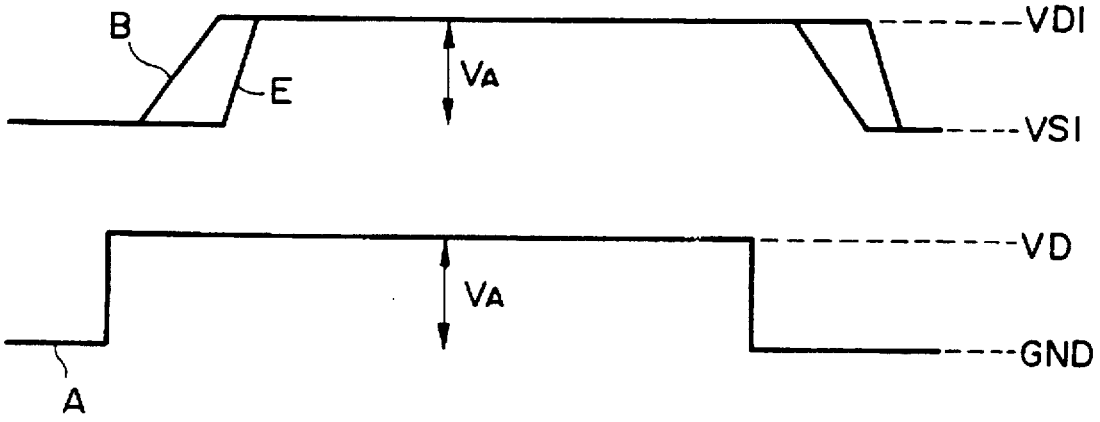

In this case, however, another problem is raised with respect to interface of control signals, signal data and scan data between the control unit 1 and the signal driver 2. This is because the logic circuit in the receiving-side signal driver 2 is actuated within the voltage range of VS1–VD1 while signals transmitted from the control unit 1 are within the voltage range of GND-VD. This embodiment avoids such a problem by providing a potential transforming unit 6 as shown in FIG. 1. FIG. 8A shows an example of the potential transforming unit 6 while FIG. 8B shows a voltage waveform for illustrating the operation of the potential transforming unit 6. The potential transforming unit 6 comprises a capacitive coupling capacitor (condenser) 12 and a DC level transmitting unit 58 which includes inverters 320, 322 and 324 and a resistor 326. The capacitor 12 cuts out any DC component in an input signal A. If it is assumed that the signal A rises as shown in FIG. 8B, a voltage difference VA=VD–GND may be transmitted to the inverter 320. Thus, the output C of the inverter 320 falls while the output D of the other inverter 324 rises. The output D is feed-back to the input of the inverter 320 through the resistor 326. The drive ability of the inverter 324 is set lower than that of the inverter 320. Thus, a latch circuit is formed by the inverters 320 and 324 and the resistor 326. This is because a voltage equal to VS1+VA must be held since only the AC components (voltage difference VA) of the signal A are transmitted to the circuit through the capacitor 12. Thus, a signal B having its amplitude within the range of VS1–VD1 as shown in FIG. 8B can be provided. A signal E is obtained by buffering the signal B by the inverter 322.

There is raised still another problem in that while VD supplied from the control unit 1 is always invariable, VD1 supplied from the power supply unit 5 is variable depending on adjustment in the variable resistor 70. For example, with 1/240 duty drive generally used in large-sized liquid-crystal panels, the voltage range B2 shown in FIG. 3 is equal to about 25 volts. In such a case, the range of voltage adjustment is equal to about 3 volts. If the variable resistor 70 is used to change the voltage by about 3 volts, the logic source voltage VD1 of the signal driver 2 will be changed by about 0.6 volts (=3 volts/25 volts). Thus, a voltage difference equal to about 0.6 volts will be generated between VD1 and VD. Even if such a voltage difference is generated between VD1 and VD, the presence of the capacitor 12 will not allow any DC current to flow between the control unit 1 and the signal driver 2. Further, if the voltages of the control signal, signal data and scan data from the control unit 1 are lower than VD1 by about 0.6 volts due to affection of the voltage adjustment, the resulting voltage difference will be lower than the threshold voltage (which is equal to about 0.7 volts) in MOS transistors which constitute inverter or the like at the input terminal of the signal driver 2. Therefore, the signal can be sufficiently transmitted while no current will flow from VD1 to VS1 in the inverter or the like at the input terminal.

As will be apparent from the above description, this embodiment can provide a power supply technique which is optimum when the range of source voltage to the scan driver is different from the range of source voltage to the signal driver as in the multiple lines selective drive technique. Even in such a case, the power supply unit 5 of simplified structure can be used to regulate the driving voltages to the liquid-crystal elements.

3. Scan Driver

Figure 9:
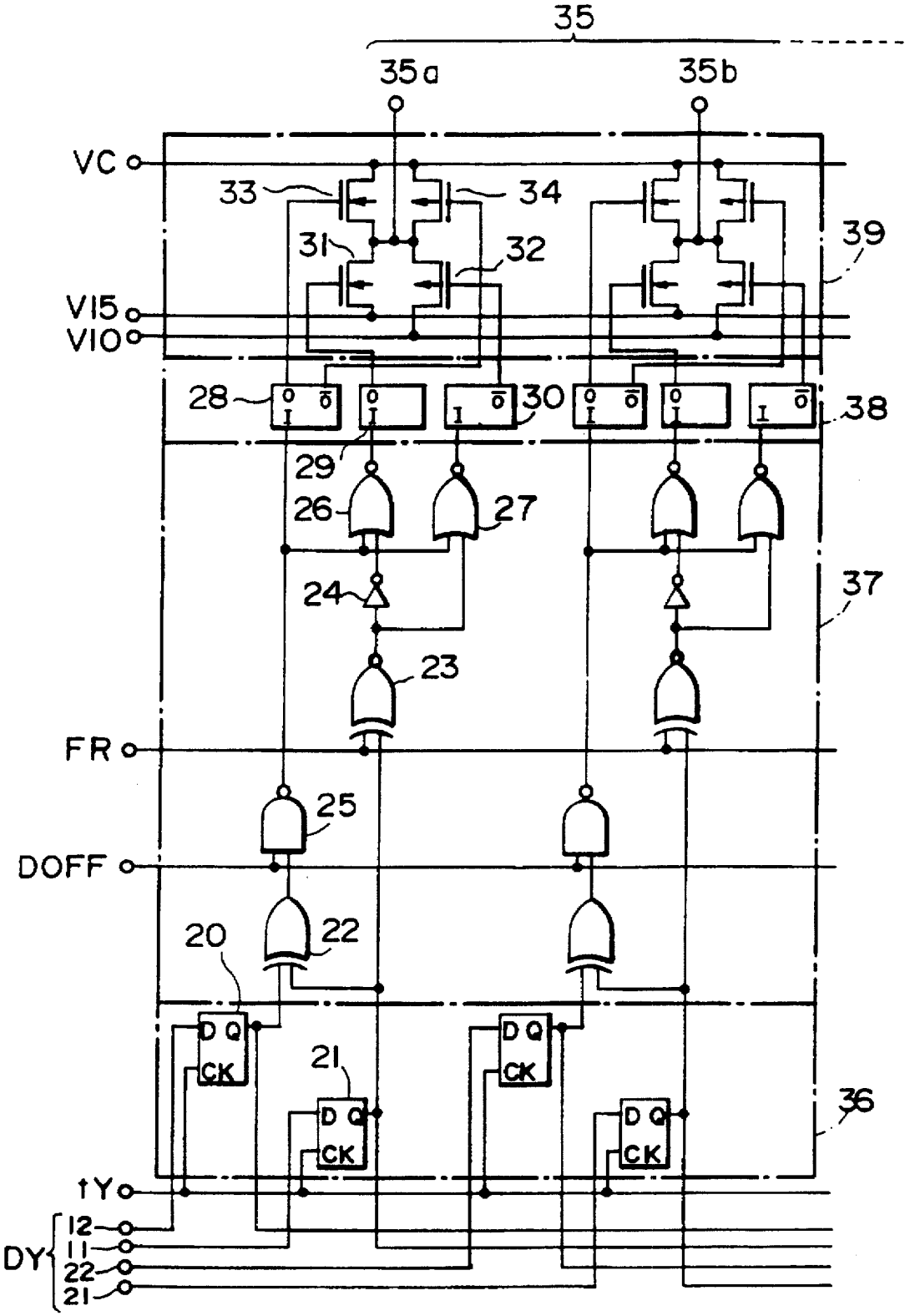
FIG. 9 is a circuit diagram showing an example of a scan driver.

FIG. 9 shows an example of the scan driver 3 for this embodiment which uses the multiple lines selective drive technique. The scan driver 3 comprises a shift register unit 36, a combinational circuit (drive signal determining circuit) 37, a level shifter unit 38 and a voltage selector unit 39. The scan driver 3 is responsive to FR, DOFF, tY and DYnm signals from the control unit 1 for selecting any one of the source voltages VC, V10 and V15 from the power supply unit 5 to form an output 35 as shown in FIG. 10A. The shift register unit 36 is a parallel type 4-bit shift register consists of D type flip-flop circuits (hereinafter called DFF) for simultaneously transferring four 2-bit output data. The combinational circuit 37 receives the output of the shift register unit 36 and FR and DOFF signals to generate a control signal which is in turn used to provide the driver output 35 shown in FIG. 10A. Such a control signal is transmitted to the voltage selector unit 39 through the level shifter unit 38. The voltage selector unit 39 is responsive to the control signal for selecting any one of three source voltages VC, V10 and V15 to generate the driver output 35.

Figure 11A:
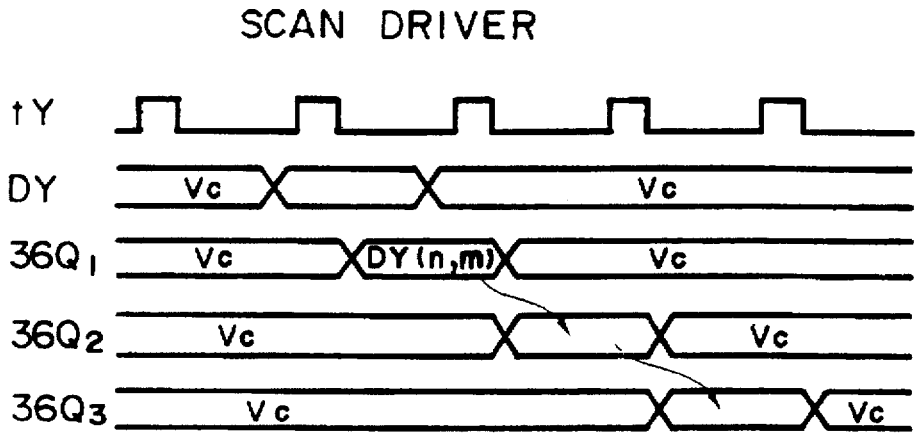
FIGS. 11A and 11B are timing charts illustrating the operations of the signal and scan drivers, respectively.

High-order bit DY12 in the 2 bits×2 lines scan data transferred from the control unit 1 is latched by DFF 20 at the rising edge of the data transfer clock tY signal. The output of the DFF 20 is inputted into DFF in the next shift register unit (not shown) which is spaced away rightward from the previous shift register unit 36 by two bits. Similarly, low-order bit DY11 in the scan data is latched by DFF 21 at the falling edge of the data transfer clock tY signal. The output of DFF 21 is inputted into DFF in the next shift register unit. As will be apparent from the timing chart of FIG. 11A, thus, the 2 bits×2 lines scan data DY can be transferred sequentially to the successive shift register units (36Q1→36Q2→36Q3). The combinational circuit 37 comprises EX-OR 22, EXNOR 23, an inverter 24, NAND 25 and NORs 26 and 27. DOFF signal is inputted into NAND 25 while FR signal is inputted into EX-NOR 23.

Figure 12B:
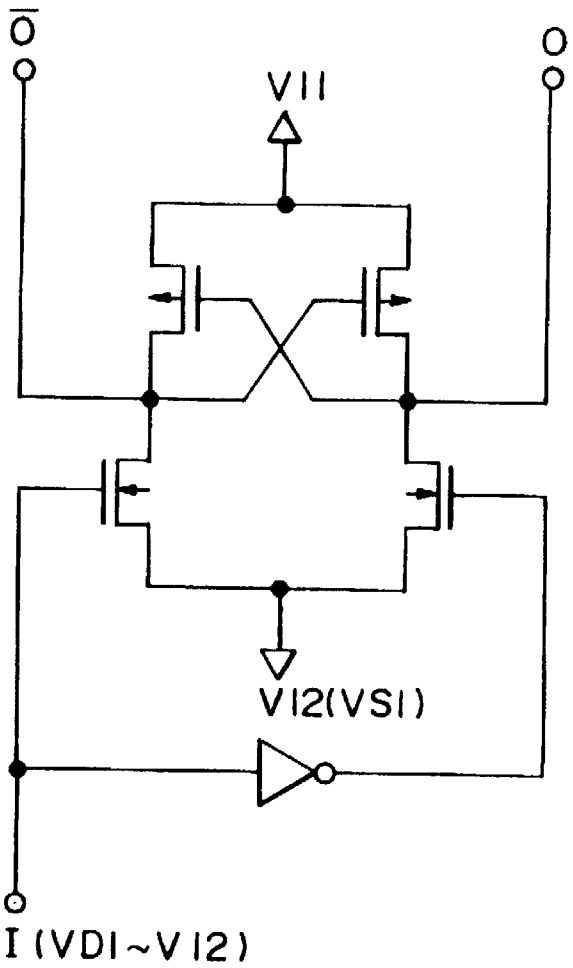
FIGS. 12A and 12B are circuit diagrams showing examples of level shifters.
Figure 12A:
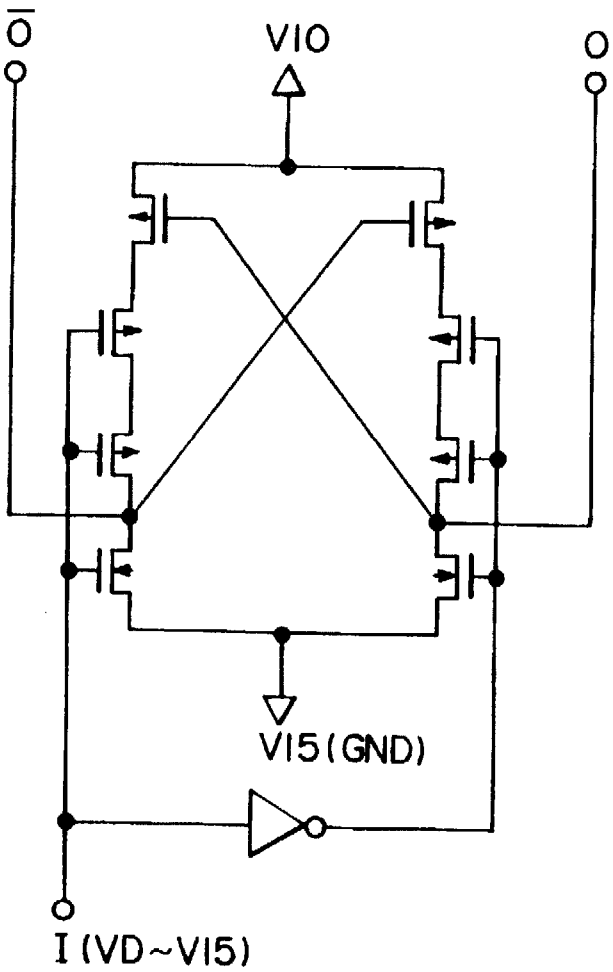

The level shifter unit 38 includes level shifters 28, 29 and 30 which function to change the voltage level of a control signal from the combinational circuit 37, from VD–V15 (GND) to V10–V15. In such a case, level shifters as shown in FIG. 12A are used since the voltage difference between V10–V15 is quite different from the voltage difference between VD–V15 (see FIG. 3).

The voltage selector unit 39 comprises N-channel transistors 31, 33 and P-channel transistors 32, 34. N-channel transistor 31 is driven by the non-inverted output of the level shifter 29 to select the V15 level while P-channel transistor 32 is driven by the inverted output of the level shifter 30 to select the V10 level. N-channel transistor 33 is driven by the non-inverted output of the level shifter 28 to select the VC level while P-channel transistor 34 is driven by the inverted output of the level shifter 28 to select the VC level.

When the low-order bit DYn1 is in high-level (H) and the high-order bit DYn2 is in low-level (L), as shown in FIG. 10A, V10 is selected if FR is in L and V15 is selected if FR is in H. V15 is a voltage symmetrical to V10 about VC as shown in FIG. 3. When DYn1 is in L and DYn2 is in H, V15 is selected if FR is in L and V10 is selected if FR is in H.

On the other hand, when DYn1 and DYn2 are in L or when DYn1 and DYn2 are in H, VC is selected independently of FR signal. Thus, this embodiment accomplishes the AC drive about VC as a center voltage. When DOFF is in L as shown in FIG. 10A, the driver output 35 is forced into VC level independently of FR, DYn1 and DYn2 signals. This is because when DOFF becomes L, the output of the NAND 25 is forced into H to make the inputs of the level shifters 28, 29 and 30 at H, L and L, respectively. As a result, the transistors 33 and 34 are selected while the transistors 31 and 32 are not selected. As will be described, this can realize the display-off function for the liquid-crystal display system.

4. Signal Driver

Figure 13:
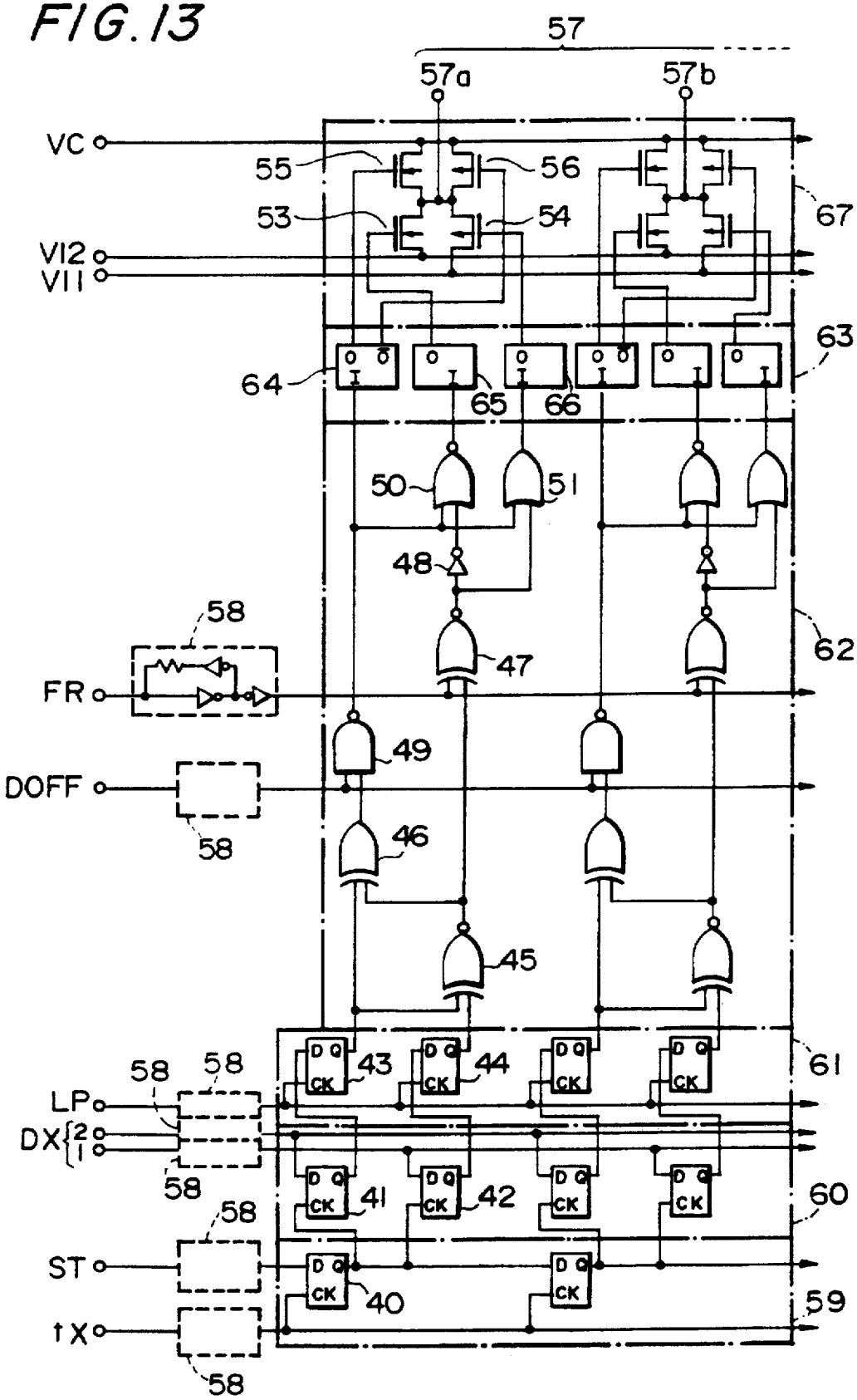
FIG. 13 is a circuit diagram showing an example of a signal driver.

FIG. 13 shows an example of the signal driver 2 according to this embodiment which uses the multiple lines selective drive technique. The signal driver 2 comprises a shift register unit 59, a data register unit 60, a data latch unit 61, a combinational circuit 62, a level shifter unit 63 and a voltage selector unit 67. The signal driver 2 is responsive to FR, DOFF, LP, DX, ST and tX signals from the control unit 1 for selecting any one of the source voltages VC, V11 and V12 from the power supply unit 5 to provide an output 57 as shown in FIG. 10B. The shift register unit 59 consists of a plurality of DFFs cascade-connected to one another and functions to generate sampling signals. The data register unit 60 is responsive to a sampling signal generated by the shift register unit 59 for sampling a signal data DX to DFFs. The data latch unit 61 is responsive to LP signal for latching data sampled by the data register unit 60. The combinational circuit 62 receives the output of the data latch unit 61 and FR and DOFF signals to generate a control signal which is in turn used to provide the driver output 57 shown in FIG. 10B. The control signal is then transmitted to the voltage selector unit 67 through the level shifter unit 63. The voltage selector unit 67 is responsive to the control signal for selecting any one of the source voltages VC, V11 and V12 to generate the driver output 57.

Figure 11B:
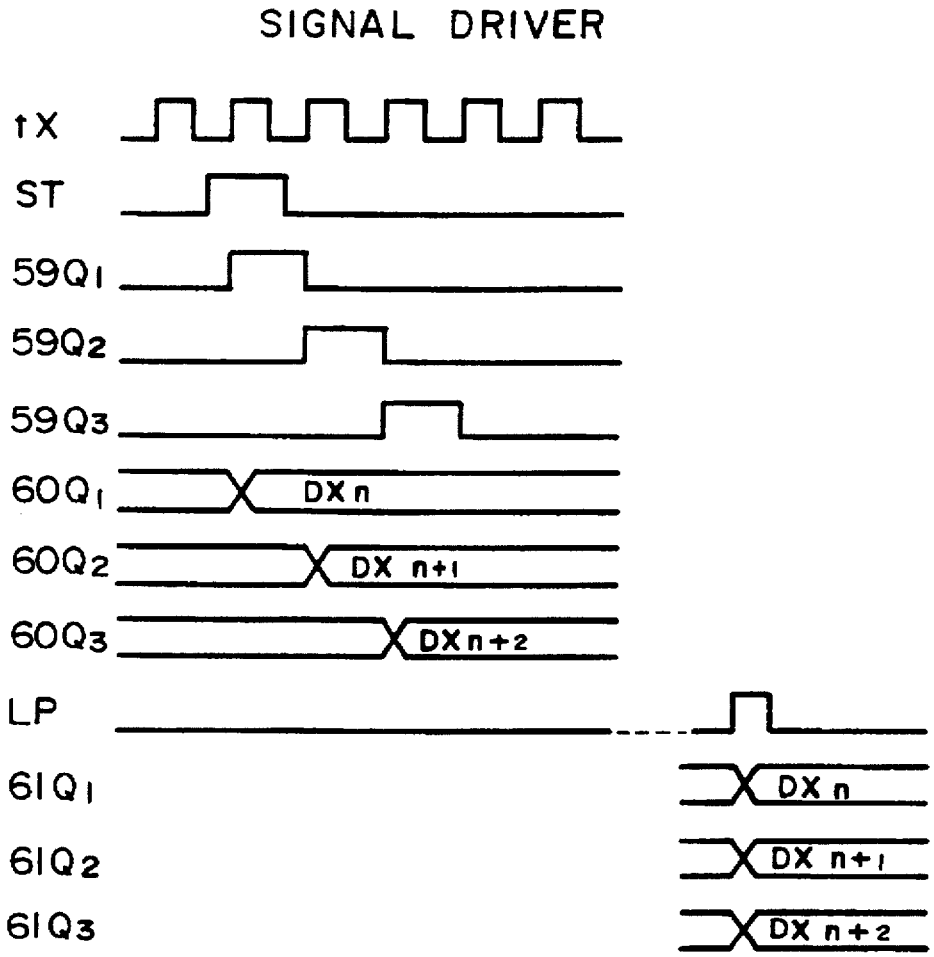

All the control signals and signal data from the control unit 1 are transformed from VD-GND level to VD1–VS1 level through the capacitive coupling capacitor 12 and DC level transmitting unit 58, the transformed signals and data being then inputted into the signal driver. A sampling signal ST is sampled by DFF 40 at the rising edge of the data transfer clock tX signal, the output of the DFF 40 being then inputted into the next DFF. As shown by the timing chart of FIG. 11B, the ST signal is sequentially transferred to the subsequent DFF. Q output of the DFF 40 is inputted into CK terminal of DFFs 41 and 42 in the data latch unit 60. As shown in FIG. 11B, low-order bit DX1 in the signal data is sampled by DFF 42 at the rising edge of the Q output of DFF 40. Similarly, high-order bit DX2 is sampled by DFF 41 at the rising edge of the Q output of DFF 40. As shown in FIG. 11B, thereafter, the outputs of DFFs 41 and 42 are latched by DFFs 43 and 44 at the rising edge of the latch pulse signal LP from the control unit 1. The combinational circuit 62 comprises EX-NORs 45 and 47, EX-OR 46, an inverter 48, NAND 49, NOR 50 and OR 51. DOFF signal is provided to NAND 49 while FR signal is inputted into EX-NOR 47.

The level shifter unit 63 includes level shifters 64, 65 and 66 which function to transform the voltage level of a control signal from the combinational circuit 62 from VD1–V12 (VS1) level to V11–V12 level. In such a case, level shifters of the structure as shown in FIG. 12B are used since the voltage difference between V11–V12 is not much different from the voltage difference between VD1–VD12 (see FIG. 3).

The voltage selector unit 67 comprises N-channel transistors 53, 55 and P-channel transistors 54, 56. N-channel transistor 53 is driven by the non-inverted output of the level shifter 65 to select the V12 level while P-channel transistor 54 is driven by the non-inverted output of the level shifter 66 to select the V11 level. N-channel transistor 55 is driven by the non-inverted output of the level shifter 64 to select the VC level while P-channel transistor 56 is driven by the inverted output of the level shifter 64 to select the VC level.

When the low-order bit DX1 is in low-level (L) and the high-order bit DX2 is in L, as shown in FIG. 10B, V11 is selected if FR is in L and V12 is selected if FR is in H. V12 is a voltage symmetrical to V11 about VC as shown in FIG. 3. When DX1 is in L and DX2 is in H, V12 is selected if FR is in L and V11 is selected if FR is in H. On the other hand, when DX1 is in H and DX2 is in L or when DX1 and DX2 are in H, VC is selected independently of FR signal. Thus, this embodiment accomplishes the AC drive about VC as a center voltage. When DOFF is in L as shown in FIG. 10B, the driver output 57 is forced into VC level independently of FR, DX1 and DX2 signals. This is because when DOFF becomes L, the output of the NAND 57 is forced into H to make the inputs of the level shifters 64, 65 and 66 at H, L and H, respectively. As a result, the transistors 55 and 56 are selected while the transistors 53 and 54 are not selected. If DOFF is in L as described, both the outputs 35 and 37 of the signal and scan drivers 2 and 3 become VC level. This can make the voltage applied to the liquid-crystal elements equal to "0". Therefore, this can realize the display-off function for the liquid-crystal display system.

Figure 19:
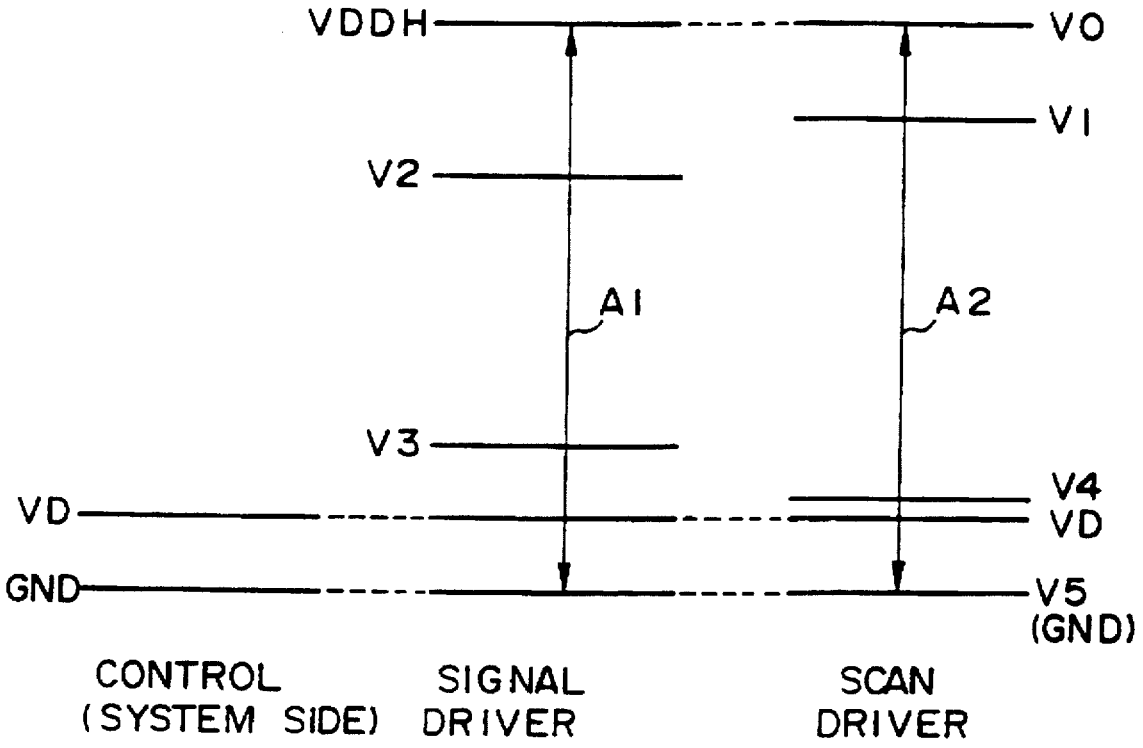
FIG. 19 PRIOR ART
FIG. 19 is a diagram illustrating the relationship between source voltage groups in the prior art using the amplitude selective addressing scheme (voltage averaging process).

The prior art utilizing amplitude selective addressing scheme in FIG. 19 can make GND which is a source voltage on the high-potential side equal to V5 (or can make VDDH equal to V10). The display-off function can be accomplished by making both the driver outputs equal to GND (V5). If the voltage range B1 is different from the voltage range B2 as shown in FIG. 3, the above technique of the prior art cannot be used since the source voltages V12 and V15 (or V11 and V10) on the high-potential side cannot be made coincident with each other. To avoid such a problem, this embodiment accomplishes the display-off function by making both the driver outputs equal to the center voltage VC when DOFF becomes L. In such a case, VC is originally a source voltage for driving the liquid-crystal and so there is no need to generate a new source voltage for accomplishing the display-off function.

In this embodiment, further, the fixed potential of the signal driver on the low-potential side is V12 (VS1), rather than GND, as shown in FIG. 3. This is accomplished by causing the potential transforming unit 6 to transform the signal data level from VD-GND to VD1–V12 (VS1) as described. When the fixed potential on the low-potential side is made V12, for example, the substrate potential of the N-channel transistor 53 can also be made V12. This can prevent a substrate bias effect (body effect) from being produced in the N-channel transistor 53. If the body effect is produced, the threshold voltage in the N-channel transistor 53 will be increased sufficient to damage the symmetry in characteristics between the N-channel transistor 53 outputting the V12 level and the P-channel transistor 54 outputting the V11 level. To avoid such a problem, this embodiment makes the fixed potential on the low-potential side V12 level to prevent creation of such a body effect and also to establish the symmetry in characteristics between the transistors 53 and 54. This facilitates the design of the liquid-crystal display system. Thus, the waveforms at the rising and falling edges of the driver output are made substantially symmetrical to each other to reduce any DC component harmful for the liquid-crystal drive. This embodiment can further reduce ON resistance to increase the drive ability since VC is driven by the transistors 55 and 56 which are arranged in a T-type gate.

Figure 14:
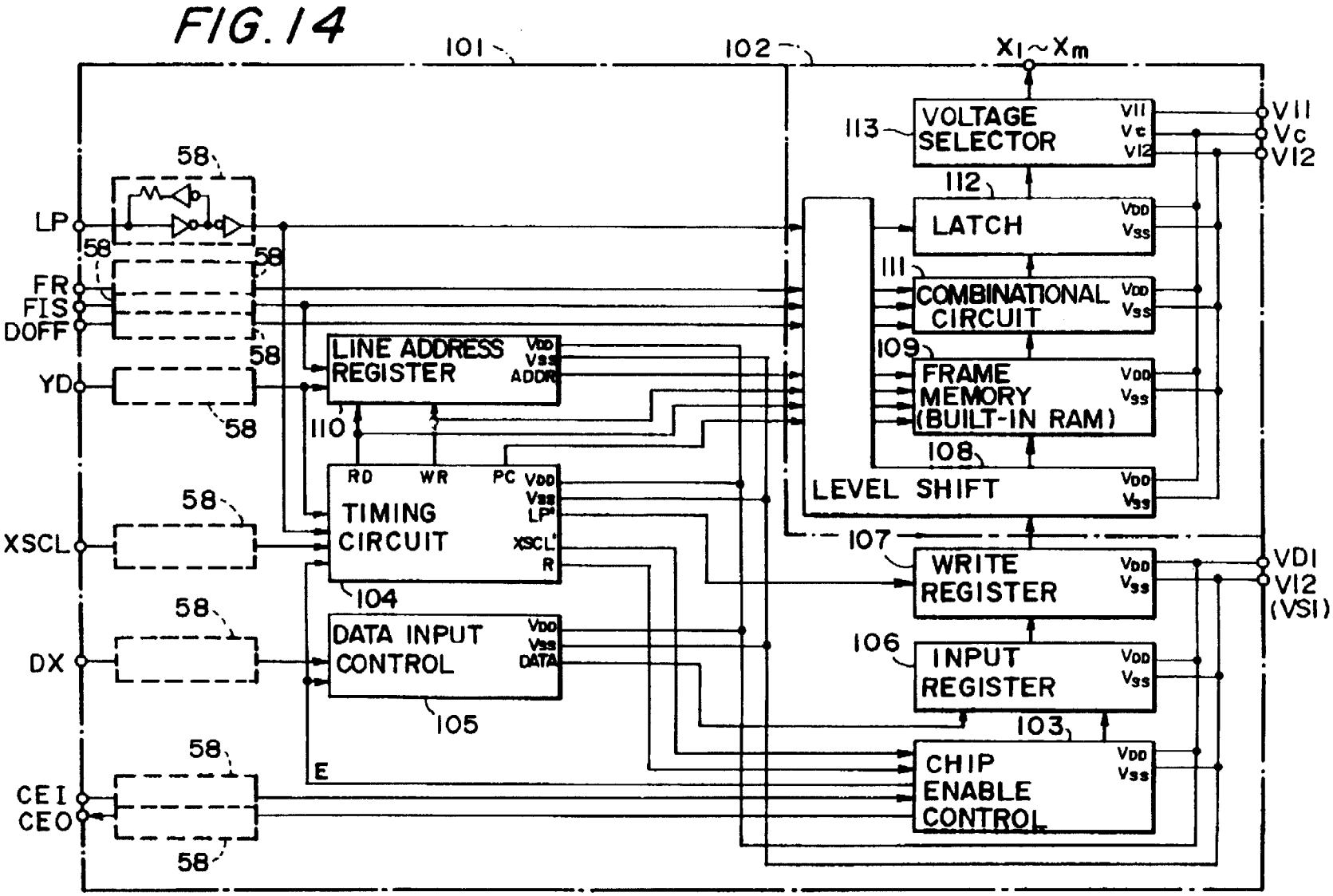
FIG. 14 is a circuit diagram showing another example of a signal driver.

FIG. 14 shows another example of the signal driver. This signal driver is of RAM built-in type. Since the RAM built-in type signal driver does not require the transfer of data if the display is invariable, the power consumption can be reduced. The signal driver comprises a chip enable control circuit 103, a timing circuit 104, a data input control circuit 105, an input register 106, a write register 107, a level shifter unit 108, a frame memory (built-in RAM) 109, a line address register 110, a combinational circuit (drive signal determining circuit) 111, a latch circuit 112 and a voltage selector unit 113. In this signal driver, a circuit disposed in a low-voltage amplitude operating unit 101 is actuated by source voltages VD1–V12 (VS1). In such a case, since LP, FR and other signals are within the range of VD-GND level, they are transformed into VD1–V12 level by the potential transforming unit 58. The frame memory 109, combinational circuit 111 and latch circuit 112 are disposed in a high-voltage amplitude operating section 102 and actuated by source voltages VC–V12. Therefore, an input signal from the low-voltage amplitude operating section 101 is transformed in voltage level by the level shifter unit 108. In such an arrangement, the frame memory 109 can be comprised of a high-resistance load type RAM since it can be driven by a source voltage having wide voltage difference than the source voltage in the low-voltage amplitude operating section 101. This can greatly reduce the chip area.

(Second Embodiment)

A power supply technique according to the second embodiment of the present invention will now be described.

FIG. 15 shows a power source used in the second embodiment. All the fixed potentials of the control unit 1, signal driver 2 and scan driver 3 on the low-potential side are GND. In such a case, the operation voltage of the signal driver 2 cannot be lowered as in FIG. 3 since the signal driver 2 is actuated by the source voltage range V15–V11. Even in FIG. 15, however, the signal driver 2 is actuated by a source voltage substantially two-third lower than that of the scan driver 3. Thus, the signal driver 2 can be manufactured through a low voltage LSI process and has an increased integrity. This is advantageous in manufacturing cost. The structure of FIG. 15 also setting the center voltage VC1 in a voltage range D1 and the center voltage VC2 in a voltage range D2 to a same level. Therefore, the display-off function can be accomplished by making the outputs of both the signal and scan drivers 2, 3 equal to VC level (=VC1, VC2). In the case of FIG. 15, the potential transforming unit 6 as shown in FIG. 1 can be eliminated since the logic circuit in the signal driver 2 is actuated by VD-GND. In addition, the power supply unit of FIG. 2 does not require the divided terminals 68 and operational amplifier 79, because there is no need to generate VD1.

(Third Embodiment)

Figure 16:
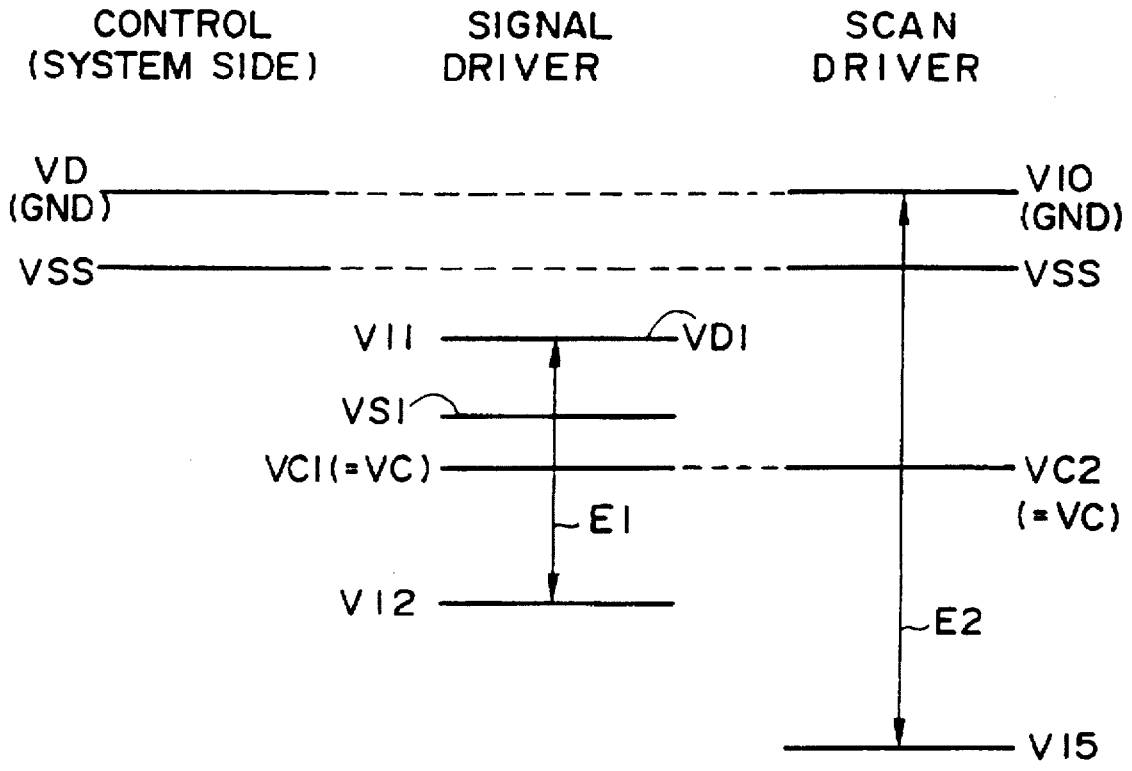
FIG. 16 is a diagram illustrating the relationship between source voltage groups in the third embodiment.

FIG. 16 shows a power source arrangement usable in the power supply technique according to the third embodiment of the present invention. Although the previous embodiment of FIG. 3 has been described as to the positive polarity in all the source voltages of the signal and scan drivers 2, 3, the case of FIG. 16 is different from it in that V10 (GND) being a power source on the high-potential side is a fixed potential and that all the source voltages are of negative polarity. The potential transforming unit 6 transforms the levels of the control and other signals from VD (GND)-VSS to VD1 (V11)-VS1. The power supply unit 5 has its high-potential side being GND and its low-potential side being VLCD to which the variable resistor 70 is connected. The logic source voltage VS1 is provided within a voltage range E1 (or may be equal to VSS as in FIG. 15).

If it is assumed that VD is the fixed potential (GND) and that the source voltages of the signal and scan drivers 2, 3 are of negative polarity, the signal and scan drivers are in a fixed potential on their high-potential side. Therefore, the drivers are comprised of semiconductor devices on a P-substrate.

(Fourth Embodiment)

Figure 17:
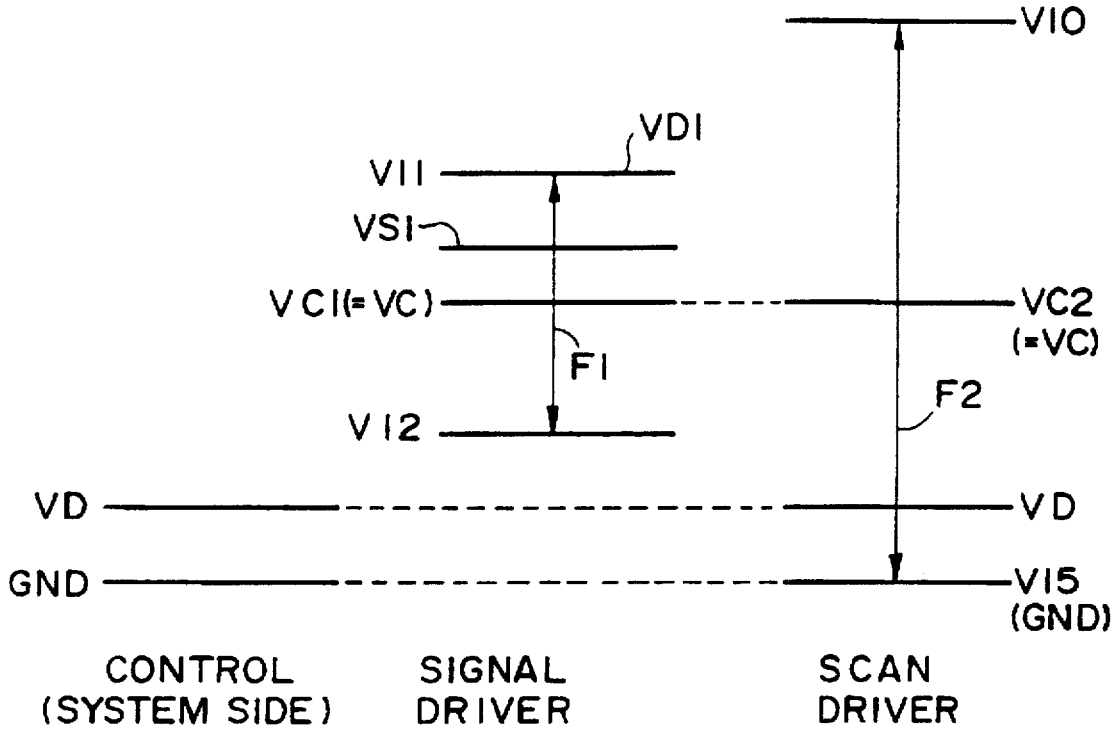
FIG. 17 is a diagram illustrating the relationship between source voltage groups in the fourth embodiment.

FIG. 17 shows another power source arrangement usable in the power supply technique according to the fourth embodiment of the present invention. In FIG. 17, all the source voltages of the signal and scan drivers are of positive polarity, as in FIG. 3. In the fourth embodiment, however, the signal driver is comprised of semiconductor devices on the P-substrate since the source voltage V11(VD1) on its high-potential side is a fixed potential, while the scan driver is comprised of semiconductor devices on N-substrate since the source voltage V15(GND) on its low-potential side is a fixed potential. Thus, the present invention may be applied to even a case wherein the substrates for semiconductor devices forming the signal and scan drivers are of different polarities, without any problem. Therefore, the present invention may be applied to even a case wherein the signal and scan drivers are comprised respectively of the N- and P-substrate semiconductor devices, contrary to the case of FIG. 17.

(Fifth Embodiment)

Figure 18:
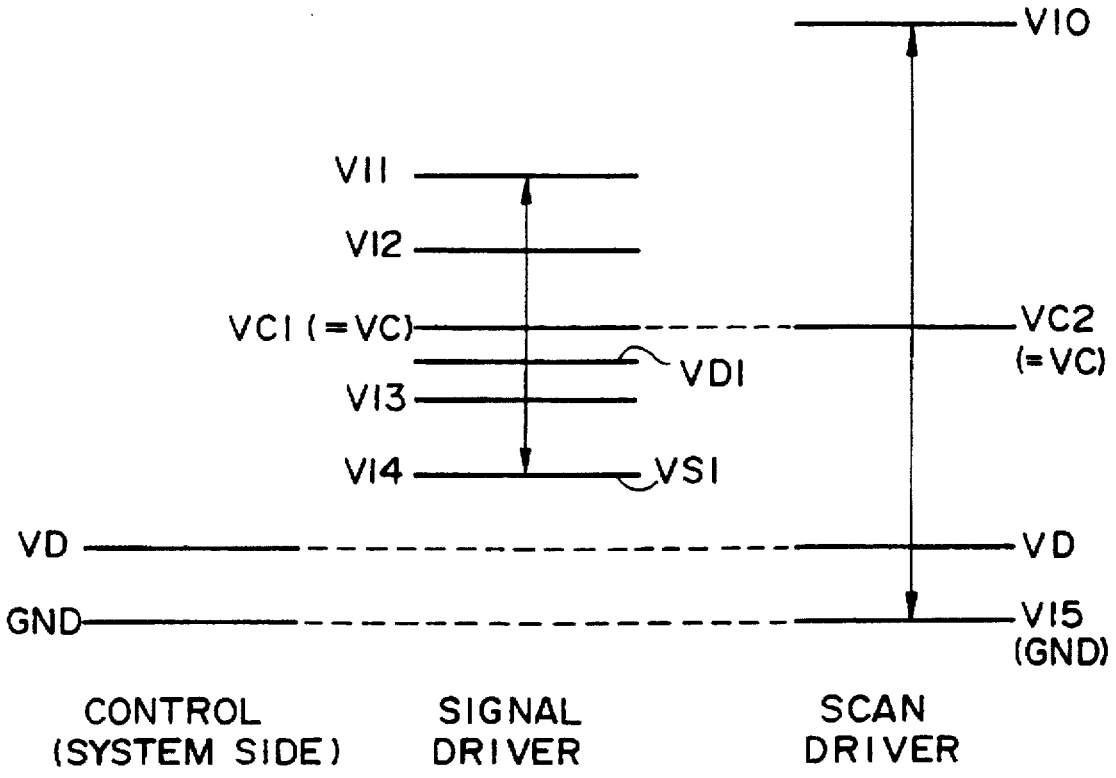
FIG. 18 is a diagram illustrating the relationship between source voltage groups in the fifth embodiment.

FIG. 18 shows still another power source arrangement usable in the power supply technique according to the fifth embodiment of the present invention. The power source arrangement of FIG. 18 is adapted to drive four lines simultaneously. If the number of lines to be simultaneously selected is equal to h, the multiple lines selective drive technique requires a source voltage of (h+1) level in the signal driver. To drive four lines at the same time, the arrangement of FIG. 18 requires five levels of the source voltages, namely, V11, V12, VC, V13 and V14. The scan driver requires three levels of the source voltages, namely, V10, VC and V15. Thus, the present invention may be applied to a case wherein the number of lines to be simultaneously selected in the signal driver is different from that of the scan driver. If the number of lines to be simultaneously selected increases, the source voltage differences in the signal and scan drivers can be reduced. This enables the drivers to be manufactured through a low voltage LSI process with reduction of the chip area.

If it is to select three lines at the same time, the source voltages in the signal driver are V11, V12, V13 and V14. In such a case, therefore, the present invention will use the source voltage VC only in the display-off mode. As the number of lines to be simultaneously selected increases, the number of necessary source voltage levels also increases. However, this can be overcome by increasing the number of divided voltages at the power supply unit and also the number of divided terminals and operational amplifiers connected thereto.

The present invention is not limited to the above embodiments, but may be carried out in any one of various other forms within the scope of the invention.

For example, the present invention may be applied similarly to a case wherein the liquid-crystal drive voltage of the signal driver is different from that of the scan driver, unlike the previous embodiments in which the liquid-crystal drive is performed through the multiple lines selective drive technique.

Although the previous embodiments have been described as to the case wherein the signal driver has narrow range of source voltage and the scan driver has wide range of source voltage, the present invention may similarly be applied to a case wherein the signal driver has wide range of source voltage and the scan driver has narrow range of source voltage.

The structure of the source voltage supply means (power supply unit) is not limited to the illustrated forms, but may be replaced by any one of various equivalent structures. For example, means for adjusting the voltage is not limited to the described form of variable resistor.

The positions of the logic source voltages are not limited to the positions of VD1 and VS1 as described in connection with the previous embodiments, but may be set at any one of various other positions. In such a case, the divided terminals for taking out these logic source voltages will also be changed.

The potential transforming unit is not limited to that of the previous embodiments, but may be replaced by any one of various other forms.

I claim:

1. A liquid-crystal display system comprising:

a signal driver for applying driving voltages to a plurality of signal electrodes which are disposed crossing over a plurality of scan electrodes in a matrix panel including a plurality of pixels arranged in a matrix, a scan driver for applying driving voltages to said scan electrodes, power supply means for supplying source voltages to said signal and scan drivers, said power supply means comprising means for supplying a first group of source voltages having a first range of source voltage and a same polarity to one of said signal and scan drivers, means for supplying a second group of source voltages having a second range of source voltage wider than the first range of source voltage and the same polarity to the other of said signal and scan drivers, and means for setting a first center voltage in the first range of source voltage and a second center voltage in the second range of source voltage to a same level, control means for outputting at least control signals to the signal and scan drivers, means for supplying a first logic source voltage to the one of said signal and scan drivers to which said first source voltage group is supplied, said first logic source voltage being within said first source voltage range and, means for supplying a second logic source voltage from the control means to the other of said signal and scan drivers to which said second logic source voltage is supplied, said second logic source voltage being within said second source voltage range.

2. A liquid-crystal display system as defined in claim 1 wherein said power supply means further comprises means for generating said first and second source voltage groups by dividing a voltage between a fixed potential and a reference potential for generating a liquid-crystal driving voltage to generate divided voltage at divided terminals, and means responsive to the divided voltage generated at one of said divided terminals for generating said first and second center voltages, thereby setting the first and second center voltages to the same level.

3. A liquid-crystal display system as defined in claim 2, further comprising means for adjusting the reference potential for generating the liquid-crystal driving voltage to regulate the divided voltages and to adjust the voltages in the first and second source voltage groups.

4. A liquid-crystal display system as defined in claim 2 wherein a fixed potential source on the low- or high-potential side of the one driver to which the first source voltage group is supplied is separated from a fixed potential source on the low- or high-potential side of the other driver to which the second source voltage group is supplied.

5. A liquid-crystal display system as defined in claim 2, further comprising means for setting the driving voltages from the signal and scan drivers to the same level as the first and second center voltages when a given external signal is inputted into the liquid-crystal display system.

6. A liquid-crystal display system as defined in claim 3 wherein a fixed potential source on the low- or high-potential side of the one driver to which the first source voltage group is supplied is separated from a fixed potential source on the low- or high-potential Side of the other driver to which the second source voltage group is supplied.

7. A liquid-crystal display system as defined in claim 1 wherein a fixed potential source on the low- or high-potential side of the one driver to which the first source voltage group is supplied is separated from a fixed potential source on the low- or high-potential side of the other driver to which the second source voltage group is supplied.

8. A liquid-crystal display system as defined in claim 7, further comprising potential transforming means for transforming the potential level of said control signal to the one driver to which the first group of source voltages are supplied into a level within the first range of source voltage.

9. A liquid-crystal display system as defined in claim 8 wherein said potential transforming means includes a capacitive coupling capacitor for cutting out DC components.

10. A liquid-crystal display system as defined in claim 7, further comprising means for setting the driving voltages from the signal and scan drivers to the same level as the first and second center voltages when a given external signal is inputted into the liquid-crystal display system.

11. A liquid-crystal display system as defined in claim 1, further comprising potential transforming means for transforming the potential level of said control signal to the one driver to which the first group of source voltages are supplied into a level within the first range of source voltage.

12. A liquid-crystal display system as defined in claim 11 wherein said potential transforming means includes a capacitive coupling capacitor for cutting out DC components.

13. A liquid-crystal display system as defined in claim 11, further comprising means for setting the driving volt ages from the signal and scan drivers to the same level as the first and second center voltages when a given external signal is inputted into the liquid-crystal display system.

14. A liquid-crystal display system as defined in claim 11, wherein said potential transforming means comprises a capacitive coupling capacitor for cutting out DC components, and a DC level transmitting unit which is connected to the coupling capacitor and includes at least one buffer and a feed-back resistor.

15. A liquid-crystal display system as defined in claim 12, further comprising means for setting the driving voltages from the signal and scan drivers to the same level as the first and second center voltages when a given external signal is inputted into the liquid-crystal display system.

16. A liquid-crystal display system as defined in claim 1 further comprising means for setting the driving voltages from the signal and scan drivers to the same level as the first and second center voltages when a given external signal is inputted into the liquid-crystal display system.

17. A liquid-crystal display system as defined in claim 1, wherein said power supply means further comprises at least one first buffer formed by a P-type operational amplifier which has a differential unit and a drive unit having a P-type drive transistor connected to the differential unit, at least one second buffer formed by a N-type operational amplifier which has a differential unit and a drive unit having a N-type drive transistor connected to the differential unit, and at least one third buffer formed by a P-N switch type operational amplifier, wherein said at least one first buffer supplies a source voltage having a charge of negative polarity to be moved from a liquid-crystal element to the first at least one buffer within one frame, said at least one second buffer supplies a source voltage having a charge of positive polarity to be moved from a liquid-crystal element to the at least one second buffer within one frame, and said at least one third buffer supplies at least one source voltage having a charge of one of negative and positive polarities to be moved from a liquid-crystal element to the at least one third buffer within one frame.

18. A power supply method for use in a liquid-crystal display system comprising a signal driver for applying driving voltages to a plurality of signal electrodes which are disposed crossing over a plurality of scan electrodes in a matrix panel including a plurality of pixels arranged in a matrix, a scan driver for applying driving voltages to said scan electrodes and power supply means for supplying source voltages to said signal and scan drivers, and control means for outputting at least control signals to the signal and scan drivers, said method comprising the steps of:

supplying a first group of source voltages having a first range of source voltage and a same polarity to one of said signal and scan drivers, supplying a second group of source voltages having a second range of source voltage wider than the first range of source voltage and the same polarity to the other of said signal and scan drivers, setting a first center voltage in the first range of source voltage and a second center voltage in the second range of source voltage to a same level;

supplying a first logic source voltage to the one of the signal and scan drivers to which said first source voltage group is supplied, said first logic source voltage being within said first source voltage range, and supplying a second logic source voltage to the control means and to the other of said signal and scan drivers to which said second logic source voltage is supplied, said second logic source voltage being within said second source voltage range.

19. A power supply method as defined in claim 18, further comprising a step of separating a fixed potential source on the low- or high-potential side of the one driver to which the first source voltage group is supplied from a fixed potential source on the low- or high-potential side of the other driver to which the second source voltage group is supplied.

20. A power supply method as defined in claim 19, further comprising a step of setting the driving voltages from the signal and scan drivers to the same level as the first and second center voltages when a given external signal is inputted into the liquid-crystal display system.

21. A power supply method as defined in claim 18, further comprising a step of setting the driving voltages from the signal and scan drivers to the same level as the first and second center voltages when a given external signal is inputted into the liquid-crystal display system.

22. A liquid-crystal display system comprising:

a signal driver for applying driving voltages to a plurality of signal electrodes which are disposed crossing over a plurality of scan electrodes in a matrix panel including a plurality of pixels arranged in a matrix, a scan driver for applying driving voltages to said scan electrodes, power supply means for supplying source voltages to said signal and scan drivers, said power supply means comprising means for supplying a first group of source voltages having a first range of source voltage, means for supplying a second group of source voltages having a second range of source voltage wider than the first range of source voltage, means for setting a first center voltage in the first range of source voltage and a second center voltage in the second range of source voltage to a same level, at least one first buffer formed by a P-type operational amplifier which has a differential unit and a drive unit having a P-type drive transistor connected to the differential unit, at least one second buffer formed by a N-type operational amplifier which has a differential unit and a drive unit having a N-type drive transistor connected to the differential unit, and at least one third buffer formed by a P-N switch type operational amplifier, wherein said at least one first buffer supplies a source voltage having a charge of negative polarity to be moved from a liquid-crystal element to said at least one first buffer within one frame, said at least one second buffer supplies a source voltage having a charge of positive polarity to be moved from a liquid-crystal element to the second buffer within one frame, and said at least one third buffer supplies a source voltage having a charge of one of negative and positive polarities to be moved from a liquid-crystal element to the third buffer within one frame.

* * * * *